US007234602B2

(12) United States Patent
Roberti

(10) Patent No.: US 7,234,602 B2
(45) Date of Patent: Jun. 26, 2007

(54) APPARATUS FOR HOLDING AND ORGANIZING ARTIST SUPPLIES

(76) Inventor: Damian Roberti, 200 Gate Rd., #210, Hollywood, FL (US) 33024

( * ) Notice: Subject to any disclaimer, the term of this patent is extended or adjusted under 35 U.S.C. 154(b) by 129 days.

(21) Appl. No.: 11/053,507

(22) Filed: Feb. 8, 2005

(65) Prior Publication Data

US 2006/0180559 A1 Aug. 17, 2006

(51) Int. Cl.
*A47B 81/02* (2006.01)

(52) U.S. Cl. ..... 211/65; 211/66; 312/206; 248/110

(58) Field of Classification Search ..... 211/65, 211/66; 206/361; 312/206; 248/110
See application file for complete search history.

(56) References Cited

U.S. PATENT DOCUMENTS

| | | | | | |
|---|---|---|---|---|---|
| 67,247 | A | * | 7/1867 | Ames et al. | 211/65 |
| 226,891 | A | * | 4/1880 | Tym | 206/216 |
| 1,471,712 | A | * | 10/1923 | Sohnle | 206/362 |
| 1,791,417 | A | | 2/1931 | Lilienfield | |
| 2,278,650 | A | * | 4/1942 | Drinkwater | 211/65 |
| 2,975,545 | A | * | 3/1961 | Moore | 211/65 |
| 3,532,222 | A | * | 10/1970 | Madden | 211/65 |
| D248,337 | S | | 6/1978 | Marx | |
| 4,134,525 | A | | 1/1979 | Respoli | |
| D260,830 | S | * | 9/1981 | Trouba | D6/552 |
| 4,446,972 | A | * | 5/1984 | Sussman | 211/26 |
| D283,561 | S | | 4/1986 | Geist | |
| 4,756,405 | A | | 7/1988 | Crozier | |
| D301,422 | S | | 6/1989 | Schmidt | |
| D304,512 | S | | 11/1989 | Byers et al. | |
| 4,884,701 | A | | 12/1989 | Nymark | |
| 5,072,904 | A | | 12/1991 | Taylor | |
| 5,222,604 | A | | 6/1993 | Tiramani | |
| 5,370,232 | A | | 12/1994 | Tiramani | |
| D354,989 | S | | 1/1995 | West | |
| D356,829 | S | | 3/1995 | Russomano et al. | |
| D372,124 | S | | 7/1996 | Dammers | |
| 5,544,764 | A | | 8/1996 | Cima | |
| D388,829 | S | | 1/1998 | Lage | |
| D391,418 | S | | 3/1998 | Roberts | |
| 5,797,489 | A | | 8/1998 | Baker | |
| D401,971 | S | | 12/1998 | Chang | |
| 5,873,462 | A | | 2/1999 | Nguyen et al. | |

* cited by examiner

*Primary Examiner*—Richard E. Chilcot, Jr.
*Assistant Examiner*—Lindsay M. Maguire
(74) *Attorney, Agent, or Firm*—Woodard, Emhardt, Moriarty, McNett & Henry LLP

(57) ABSTRACT

An apparatus for holding and organizing artist supplies includes a base having two legs and a ground-engaging surface; a handle extending between the legs of said base; and, a holder including a plurality of plates with long edges and being connected to each other at such long edges, at least one of the plates being immovably connected to and between the two legs a distance above the ground-engaging surface. At least one of the plates defines a plurality of variously sized holes sized to receive and hold a plurality of variously sized paint brushes.

17 Claims, 22 Drawing Sheets

APPARATUS FOR HOLDING AND ORGANIZING ARTIST SUPPLIES

FIELD OF THE INVENTION

The present invention relates to devices for artist supplies, and more specifically, an apparatus for holding and organizing paint brushes, paints and other artist supplies.

BACKGROUND OF THE INVENTION

Artists use a wide variety of equipment and supplies including paint bushes, paints, charcoals, chalks, water and the like. Organization of such items is often lacking, making it difficult, for example, to find a right brush when needed. When more than one artist are sharing equipment or supplies, a lack or organization of the equipment further compounds the problem. What is needed is an improved apparatus for holding, storing and organizing artist supplies.

SUMMARY OF THE INVENTION

Generally speaking, an apparatus is provided for holding and organizing artist supplies, such as paint brushes, paints, water, chalks, charcoals, pens, pencils, texturizers and the like. Such apparatus is configured to provide organization to such supplies and to facilitate easy access by several artists all accessing the same equipment.

An apparatus for holding and organizing artist supplies includes a base having two legs and a ground-engaging surface; a handle extending between the legs of said base; and, a holder including a plurality of plates with long edges and being connected to each other at such long edges, at least one of the plates being immovably connected to and between the two legs a distance above the ground-engaging surface. At least one of the plates defines a plurality of variously sized holes sized to receive and hold a plurality of variously sized paint brushes.

It is an object of the present invention to provide an improved device for holding and organizing artist supplies.

Other objects and advantages of the present invention will become apparent from the following description of the preferred embodiment.

DESCRIPTION OF THE PREFERRED EMBODIMENT

Figure 1:
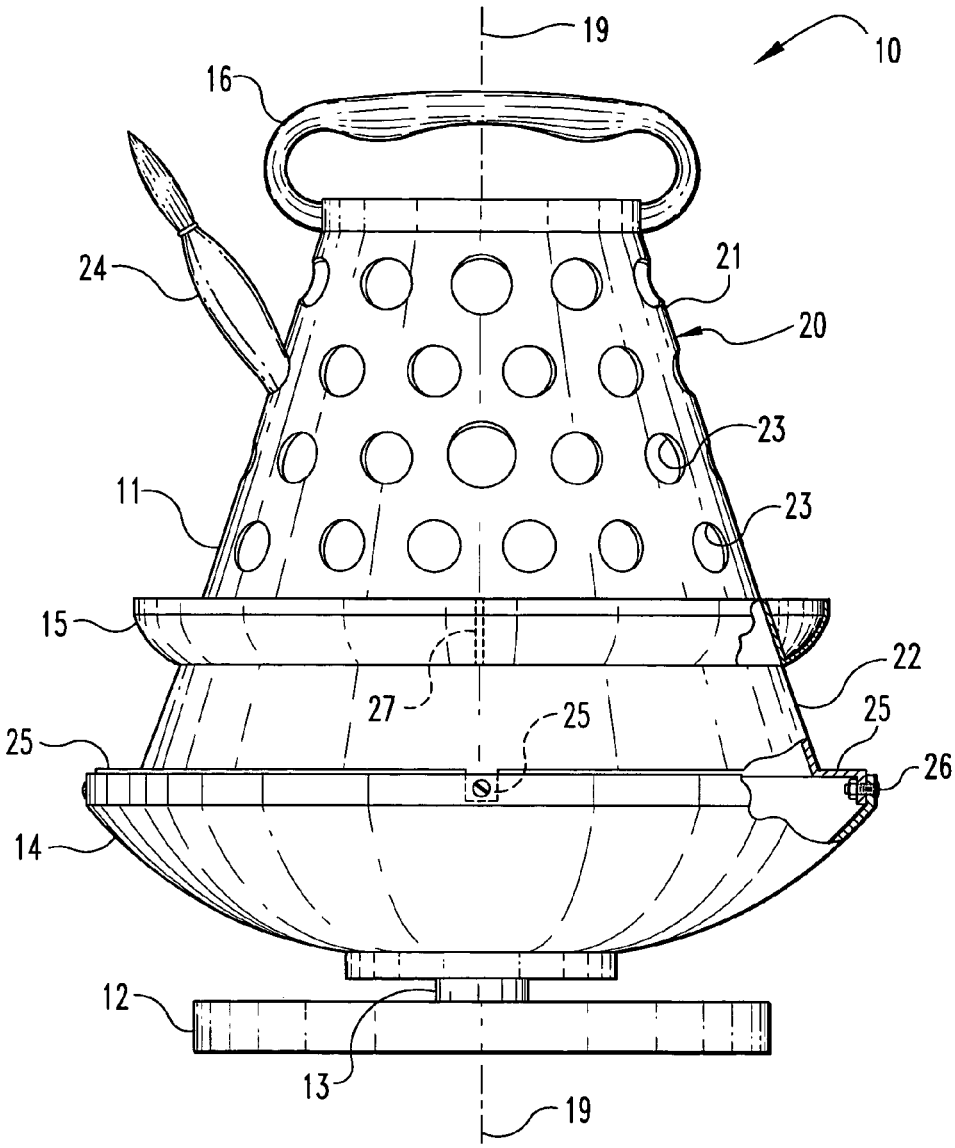
FIG. 1 is an elevational view of an apparatus 10 for holding and organizing artist supplies in accordance with one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Referring to FIG. 1, there is shown an apparatus 10 for holding and organizing artist supplies in accordance with one embodiment of the present invention. Apparatus 10 generally includes a holder 11, a base 12, a spindle 13, a bowl 14, a color palette 15, and a handle 16. Spindle 13 extends up from base 12 and has an axis 19. Bowl 14 is generally circular and is coaxially mounted to spindle 13 for rotation about axis 19. In one embodiment, bowl 14 is configured to hold water; however, in other embodiments bowl 14 can contain various other artist supplies. Holder 11 is generally frustoconical, with an outer surface 20, a top portion 21 and a bottom portion 22. In upper portion 21 there are defined a number of variously sized and spaced holes 23 for receiving and holding paint brushes 24 of various types, shapes and sizes. The number and sizes of holes 23 may vary as desired to accommodate the variety of brushes contemplated for use with apparatus 10. Paint trough 15 is an annular-shaped trough sized and configured to sit around holder 11, as shown, and to hold the artist's paint. Its internal dimension relative to the outer dimensions of holder 11 determines its vertical position on the exterior of holder 11. Trough 15 is contemplated to have one or more radial walls 27 to divide the trough into numerous sections to keep paint colors separate.

Figure 2:
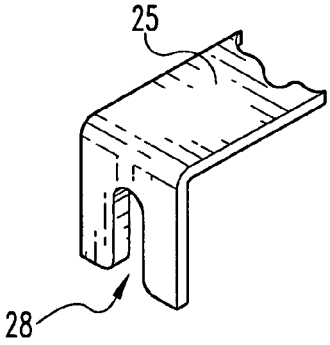
FIG. 2 is a perspective view of an alternative embodiment of leg 25 of apparatus 10 of FIG. 1.
Figure 3:
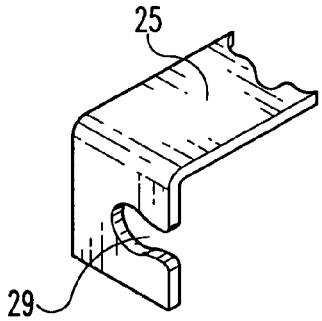
FIG. 3 is a perspective view of an alternative embodiment of leg 25 of apparatus 10 of FIG. 1.

At its bottom 22, holder 11 has a plurality of legs 25 extending outwardly, as shown. Legs 25 are connected to the upper portion of bowl 14 by any appropriate means such as screws or bolt and nut combinations 26, and holder 11 is thereby supported upon bowl 14. In the present embodiment, there are four such legs 25 evenly spaced about the periphery of bottom portion 22. Holder 11 and its legs 25 are made of any appropriate material capable of enduring the attendant forces, such as supporting the weight of brushes 24, color palette 15 and paint contained therein as apparatus 10 sits on a surface or is carried by handle 16. In the present embodiment, the distal ends of legs 25 have defined therein holes sized for receipt of bolt and nut combination 26 to lock holder 11 to bowl 14. Alternative embodiments are contemplated (FIG. 2) wherein the distal ends of legs 25 define downwardly opening slots 28, which enables holder 11 to be lowered into place onto bowl 14. When each bolt of combination 26 is fully received within a corresponding slot 28, the bolt and nut combination 26 is tightened. Yet another embodiment (FIG. 3) contemplates the distal ends of legs 25 defining a laterally extending slot 29 which enables holder 11 to be lowered to bowl 14 and then slightly rotated about axis 19 to cause each bolt of combination 26 to enter its corresponding slot 29. Each bolt and nut combination 28 is then tightened to lock holder 11 in place with bowl 14. Alternatively, slot 29 can be sized and shaped so that a slightly greater force is required to force the bolt into (or out of) the shaped slot 29 and whereby the bolt is releasable locked in the slot 29 and without bolt and nut combination 26 needing to be tightened. This allows holder 11 and bowl 14 to be separated and reassembled without tools, but provides a substantially secure connection therebetween.

Apparatus 10 is designed to rotate on base 12 and about axis 19 similar to a "lazy Susan"-type assembly, providing for easy access to all sides of holder 11, paint trough 15, and bowl 14. The connection between spindle 13 and bowl 14 and/or between spindle 13 and base 12 comprises any appropriate structure operable to enable such rotation, such as a ball-bearing assembly. The connections among base 12, spindle 13 and bowl 14 are contemplated to be removable connections to enable apparatus 10 to stay connected when lifted by handle 16, but to also permit disassembly for cleaning.

As shown, holder 11, paint trough 15, bowl 14, and base 12 all have generally circular cross sections in planes perpendicular to axis 19. All components of apparatus 10 are generally oriented symmetrically about axis 19. However, other embodiments are contemplated wherein holder 11, base 12, bowl 14 and/or trough 15 are shaped other than circular, such as, and without limitation, rectangular or circular. In one embodiment, the components of apparatus 10 are formed from a plastic material; however, it should be appreciated that the components can be configured from other appropriate materials as would generally occur to those skilled in the art.

Figure 4:
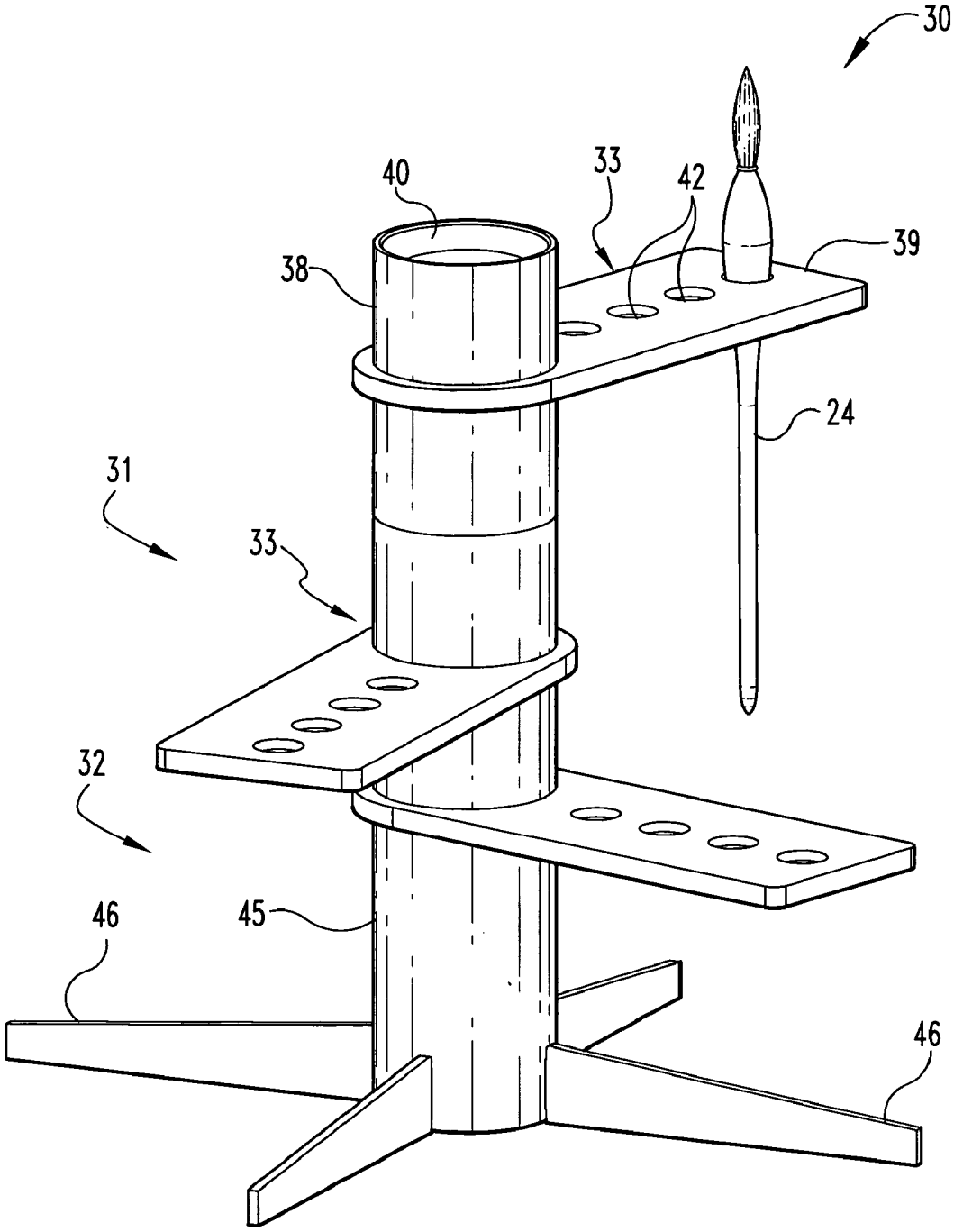
FIG. 4 is a perspective view of an apparatus 30 for holding and organizing artist supplies in accordance with another embodiment of the present invention.
Figure 5:
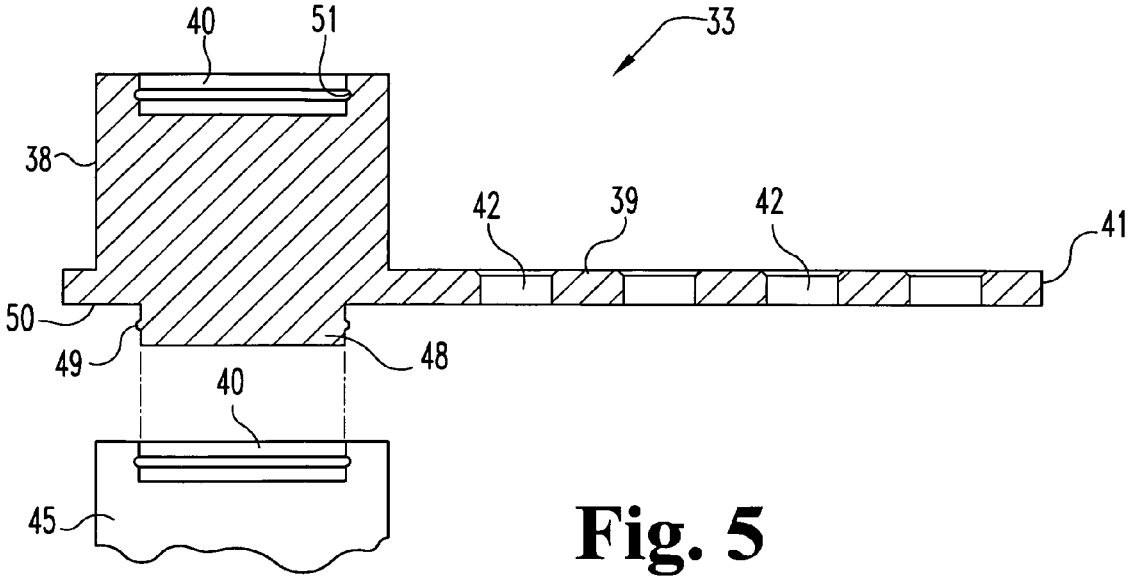
FIG. 5 is a side cross-sectional view of one of the wing assemblies 33 of apparatus 10 of FIG. 4

Referring to FIGS. 4 and 5, there is shown an apparatus 30 for holding and organizing artist supplies in accordance with another embodiment of the present invention. Apparatus 30 generally includes a holder 31 and a base 32. Holder 31 includes at least one and preferably two or more wing assemblies 33. Wing assemblies 33 are shown to be identical in FIG. 4, but may vary in size, shape, number of holes or other features. Here, each wing assembly 33 includes a cylinder block 38 and at least one wing 39. At its top, cylinder block 38 defines a central recess 40 for receiving the stub 48 of another wing assembly 33. At its proximal end, wing 39 is connected to cylinder block 38 and extends radially outwardly therefrom to its distal end 41. Wing 39 defines a plurality of openings 42 sized to receive and hold artists' implements, such as paint brushes 24. As illustrated, wing 39 defines four openings per wing 39, but there can be more or fewer openings 42, as desired. Openings 42 have varying diameters to receive paint brushes of varying sizes. That is, a portion of a standard paintbrush shaft will be of a diameter larger than the rest of the shaft and of one of the holes 42 of a wing 38, and the brush 24 will thus be supported in that hole 42, as shown in FIG. 4.

Base 22 includes a central block 45 and four legs 46 that extend radially therefrom to support assembly 30. Legs 46 are connected to central block 45 by any appropriate means such as screws, nails, pins, adhesive material or other connection mechanisms, or central block 45 and legs 46 may be formed as one integral, homogeneous piece. In the present embodiment, there are four such legs 46 evenly spaced about the periphery of central block 34, but there may be more or fewer legs 46, so long as such legs provide a stable base for apparatus 30. Other embodiments contemplate base 32 having instead of legs 46, a round or multi-sided base member (not shown), from which central block 45 extends upwardly. Legs 46 are made of any appropriate material capable of supporting the weight of paint brushes or other artists' implements held by assembly 30.

Referring to FIG. 5, there is shown a cross sectional view of a wing assembly 33 and a portion of central block 45 illustrating the components that allow a wing assembly 33 and base 32 to snap together, and allow two wing assemblies 33 to snap together, and thus form apparatus 30. At its bottom, each cylinder block 38 has a reduced diameter, thereby forming a stub 48, which has an outwardly extending locking ridge 49. Ridge 49 may be a continuous ridge that surrounds and extends outwardly from stub 45, or it may comprise any similar structure, such as two or more separate and discrete protrusions spaced about stub 45. The reduction in diameter of cylinder block 38 forms a ledge 50 between the main body of cylinder block 38 and stub 48. The central recess 40 of central block 45 and of each cylinder block 38 defines a groove 51 sized for snap-in and rotatable receipt of the locking ridge 49 and stub 48 of a cylinder block 38. Thus, one wing assembly 33 is coaxially and rotatable connected with central block 45 or another wing assembly 33 by coaxially pushing the stub 45 of the wing assembly 33 into the central recess 40. The locking ridge 49 is configured to ride within the groove 51 of the subjacent central block 45 or cylinder block 38 and allow the wing assembly 33 to rotate or swivel relative to its subjacent central block 45 or cylinder block 38.

Similar to apparatus 10, the components of apparatus 30 are plastic, but any other appropriate material may be used as would generally occur to those skilled in the art. It is further contemplated that low friction materials or inserts at stub 48 and/or recess 40 may be used to make wing assemblies 33 rotate easily. Also contemplated to facilitate smooth and easy rotation of wing assemblies 33 are appropriate lubricants or mechanical assists such as ball bearings.

Figure 6:
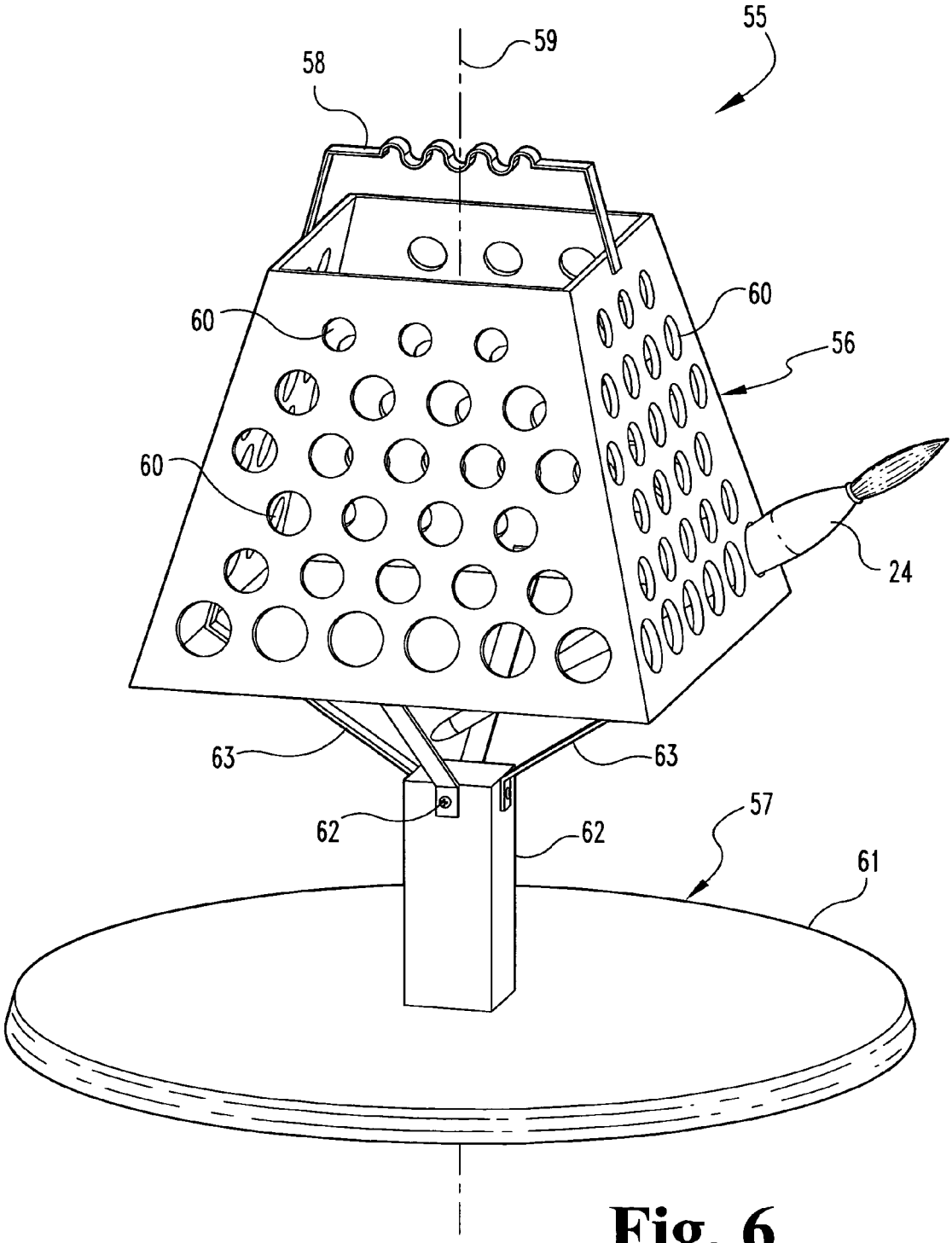
FIG. 6 is a perspective view of an apparatus 55 for holding and organizing artist supplies in accordance with another embodiment of the present invention.

Referring to FIG. 6, there is shown an apparatus 55 for holding and organizing artist supplies in accordance with another embodiment of the present invention. Apparatus 55 generally includes a holder 56, a base 57, handle 58 and a central axis 59. Holder 56 has the shape of a hollow pyramidal frustum and, like holder 11 of apparatus 10, it has defined therein a number of variously sized and spaced holes 60 for receiving and holding paint brushes 24 of various types, shapes and sizes. The number and sizes of holes 60 vary as desired to accommodate brushes of varying sizes. Handle 58 is securely attached to holder 56 and is shaped and configured to reliably support the weight of apparatus 55 and a set of brushes upon lifting by handle 56. Base 57 includes a baseplate 61, a support post 62 rigidly connected and extending upwardly from baseplate 61, and four support arms 63. Support arms 63 are connected in any appropriate manner, such as screws, to connect to post 62 and extend therefrom up to holder 56, as shown, where they are securely connected thereto by any appropriate means such as metal bonding, adhesive or screws. Holder 56, handle 58 and arms 63 are made of any appropriate material capable of supporting the weight of paint brushes and/or other various artists' implements held by holder 56.

Alternative embodiments are contemplated where holder 56 has other than a four-sided pyramidal frustum shape. For example, like holder 11 of apparatus 10, holder 56 may have a frustoconical configuration, thus forming a circular lateral cross section. All components of apparatus 55 are generally oriented symmetrically about axis 59. However, it should be appreciated that apparatus 55 can be configured differently as would occur to those skilled in the art.

Figure 7:
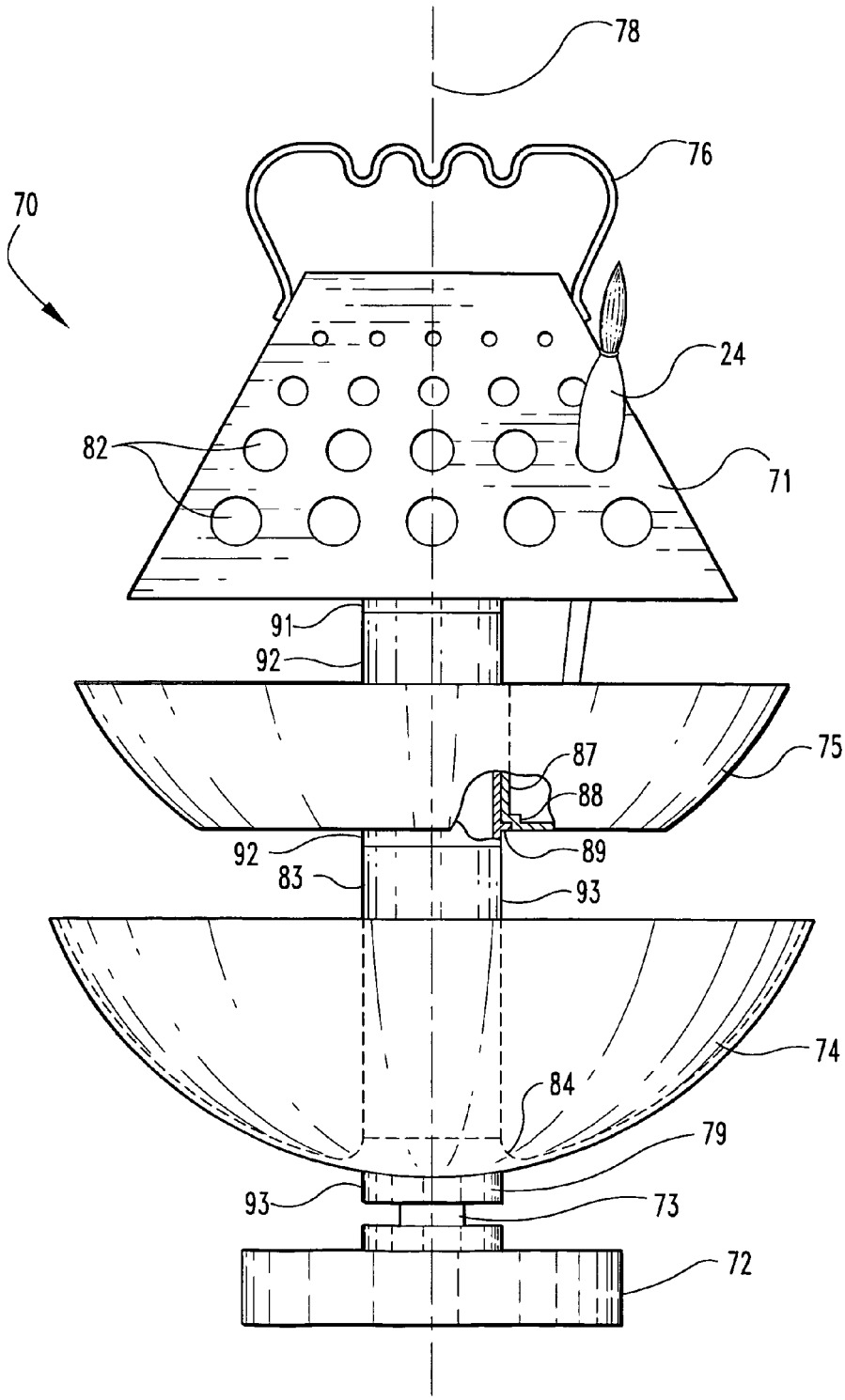
FIG. 7 is an elevational view of an apparatus 70 for holding and organizing artist supplies in accordance with another embodiment of the present invention.

Referring to FIG. 7, there is shown an apparatus 70 for holding and organizing artist supplies in accordance with another embodiment of the present invention. Apparatus 70 generally includes a holder 71, a base 72, a spindle 73, a bowl 74, a color palette 75, and a handle 76. Spindle 73 extends up from base 72 and has an axis 79. Bowl 74 is generally circular and is coaxially mounted to spindle 73 for rotation about axis 78 and by any appropriate means such as with a ball bearing assembly. In one embodiment, bowl 74 is configured to hold water or other liquids. In other embodiments, bowl 74 can contain various other artists' supplies such as chalk, erasers, cotton, sharpeners, glue, etc. and may have divisions (not shown) to provide separate and distinct compartments for holding separately any of the water or other artist supplies. At its bottom, bowl 74 has a reduced diameter section 79 with a hole (not shown) to locate and connect bowl 74 to spindle 73. Holder 71 is a hollow pyramidal frustum and defines a number of variously sized and spaced holes 82 for receiving and holding paint brushes 24 of various types, shapes and sizes. The number and sizes of holes 82 may vary as desired to accommodate the variety of brushes 24 contemplated for use with apparatus 70. In one embodiment, the hole sizes vary among 3/16 inch, 5/16 inch, 7/16 inch, 1/2 inch, 3/4 inch and 1.0 inch. In the present embodiment, spindle 73 extends only between base 72 and bowl 74. The remaining elements, trough 75 and holder 71, are supported for rotation about axis 78 by a central column 83 that extends up from bowl 74, as shown. Bowl 74 includes a mounting port 84 into which central column 83 is secured by any appropriate means, such as a threaded connection. Paint trough 75 is configured to surround and connect with central column 83. As shown, paint trough 75 is trough shaped, generally like trough 15 (FIG. 1) to hold amounts of paint. Trough 75 has a central, cylindrical core portion 87 with a recess 88 that sits on an outwardly extending ridge 89 of central column 83 to support and permit rotation of trough 75 thereon. Other configurations are contemplated to support and permit rotation of trough 75 relative to central column 83 such as, and without limitation, a ball bearing assembly. Further, it should be appreciated that color palette 75 can be divided into numerous sections to keep paint colors separate.

Holder 71 can be connected to central column 83 by various means as would generally occur to one skilled in the art. As an example, holder 71 can have a plurality of legs (not shown), extending outwardly, which are connected to central column 83 by any appropriate means such as screws or pin assemblies. Such legs can be at the top, bottom, or both of holder 71. Further, at its bottom, holder 71 can have a solid base that is placed on the top of central column 83 and connected thereto by appropriate means. In another embodiment, central column 83 can extend up through holder 71 and connect directly with handle 76. Holder 71 is made of any appropriate material capable of supporting the weight of brushes 84.

Similar to the embodiment of FIG. 1, apparatus 70 is designed to rotate similar to a "lazy Susan"-type assembly, providing for easy access to all sides of holder 71, color palette 75, and bowl 74. Spindle 73 can incorporate a ball-bearing assembly or other type of assembly to rotate or spin an object as would occur to those skilled in the art. Thus, in one embodiment, bowl 74 is rotatably connected to base 72, central column 83 is rigidly connected to bowl 74, and central column 83 comprises a single piece to which holder 71 and paint trough 75 are rigidly connected, thereby allowing holder 71, trough 75 and bowl 74 to rotate as a unit upon base 72. Other embodiments are contemplated wherein the central column 83 includes (or replaces) spindle 73 and is configured to comprise individual column sections such as sections 91, 92 and 93, which are rotatable connected together. In one such embodiment, holder 71 is rigidly connected to section 91; trough is rigidly connected to section 92; and, bowl is rigidly connected to section 93. Section 93 is rigidly connected to base 72. As such, each of holder 71 and trough 75 can be rotated relative to each other and to bowl 74. If desired, section 93 can be made to rotate relative to base 72, as well.

As shown, color palette 75, bowl 74, spindle 73, and base 72 all have generally circular lateral cross sections. In another embodiment, holder 71 has a frustoconical configuration about axis 78 and thus has a generally circular lateral cross section. All components of apparatus 70 are generally oriented symmetrically about axis 78. However, it should be appreciated that apparatus 70 can be configured differently as would occur to those skilled in the art. In one embodiment, the components of apparatus 70 are formed from a plastic material; however, it should be appreciated that the components can be configured from other appropriate materials as would generally occur to those skilled in the art.

Figure 8:
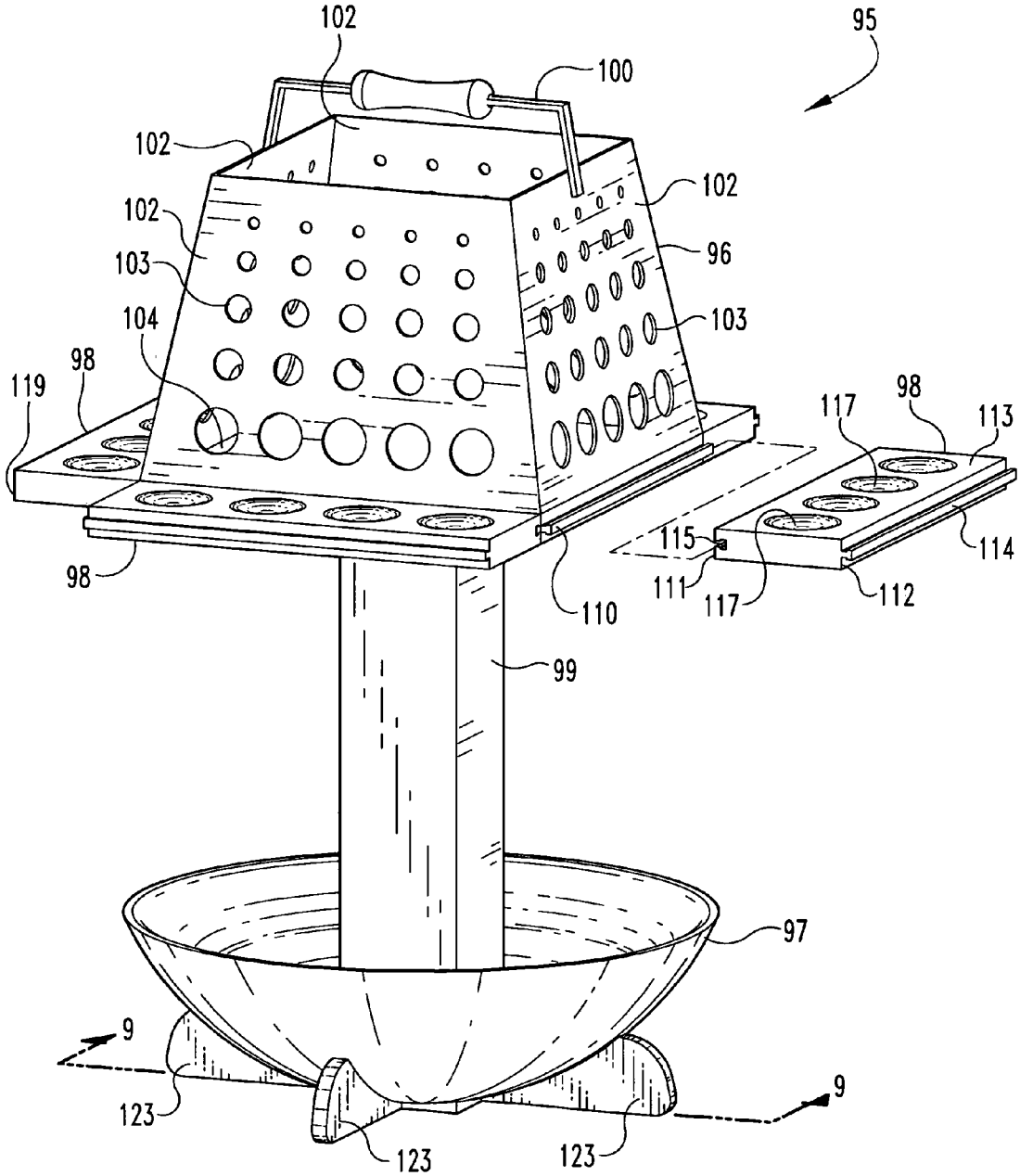
FIG. 8 is an perspective view of an apparatus 95 for holding and organizing artist supplies in accordance with another embodiment of the present invention.
Figure 9:
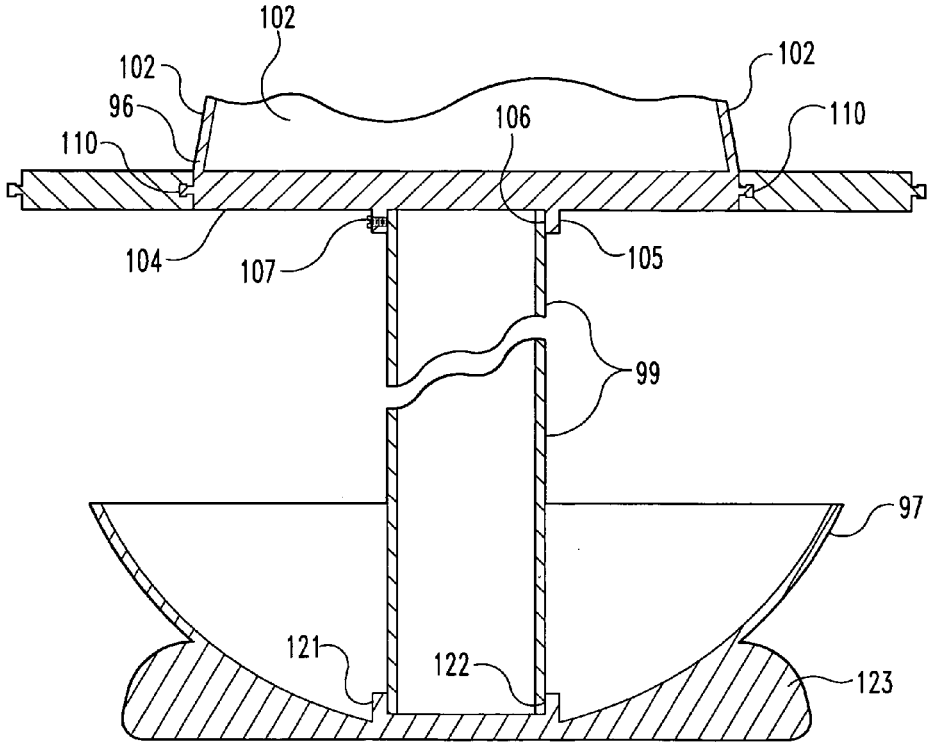
FIG. 9 is a cross-sectional, fragmented view of the apparatus 95 of FIG. 8 taken along the lines 9—9 and viewed in the direction of the arrow.

Referring to FIGS. 8 and 9, there is shown an apparatus 95 for holding and organizing artist supplies in accordance with another embodiment of the present invention. Apparatus 95 generally includes a holder 96, a bowl 97, paint pallets 98, a central column 99 and a handle 100. Like holder 56 of apparatus 55 (FIG. 6), holder 96 has a pyramidal frustum shape with four sidewalls 102, each having defined therein a plurality of variably shaped holes 103. In addition, holder 96 includes a base 104 rigidly connected with and extending between the four opposing sidewalls 102. At its center, base 104 includes a downwardly extending flange 105 that defines a recess 106 shaped for receipt of central column 99.

In the present embodiment, central column 99 has a square cross section and is sized and shaped relative to recess 106 for a snug fit. Upon lowering holder 96 onto central column 99 with column 99 received within recess 106, a setscrew 107 is tightened to removably lock holder 96 atop central column 99. At the junction of each of the four walls 102 with their base 104, holder 96 defines an outwardly extending, elongate T-flange 110.

Paint pallets are generally identical, except as noted herein. Each paint pallet 98 is generally a rectangular-shaped plate with opposing elongate edges 111 and 112 and a top surface 113 extending therebetween. In one embodiment, one edge 112 includes an outwardly extending T-flange 114 that is identical in sized and shape to T-flange 110 of holder 96. The opposing edge 111 defines an elongate T-shaped recess (a T-slot) 115, the size and shape of which exactly matches any T-flanges 110 or 114. Each paint pallet 98 is thus securely connected to holder 96 by inserting one end of a T-flange 110 into the T-slot 115 of a paint pallet 98 and sliding the pallet 98 until it is fully positioned along the bottom edge of and in alignment with the corresponding sidewall 102, as shown in FIG. 8. Such pallet 98 can be slidably removed for replacement or cleaning. Further, detents and corresponding notches (not shown) may be provided in the T-slots 115 and T-flanges 110, respectively, to allow paint pallets 98 to click into place (aligned with a respective side wall 102) and thus resist sliding movement of a pallet 98 during normal use. The top surface 113 of each paint pallet 98 defines a plurality of recesses 113, approximately one inch in diameter, to hold desired amounts of various paints. In the present embodiment each paint pallet 98 is shown with four such recesses 117; however, other embodiments are contemplated where there are more or fewer such recesses 117 including, but not limited to, one common recess. Alternatively, one or more of the paint pallets 98 may have no recesses, but may be flat. Because each paint pallet 98 also has an elongate T-flange 114, another paint pallet 98 could be slidably connected to a paint pallet 98 that is already connected with holder 96, thereby increasing the number of paint pallets connectable with holder 116 and increasing the space for paint. In another embodiment, one or more of paint pallets 98 are not provided with their own T-flange 114, as shown at 119 on one of the paint pallets 98 of FIG. 8.

Like base 104 of holder 96, bowl 97 is provided with a flange 121 for connecting with central column 99. Flange 121 extends upwardly from the central portion of the inside of bowl 97 and, like flange 105, flange 121 defines a central recess 122 that is sized to snugly receive the bottom end of square-cross sectioned central column 99. The dimensions of recess 122 and column 99 may be made snug enough to create a pressure fit therebetween. In the alternative, a set screw (not shown) may be used, like set screw 107 at the top of column 99, to removably secure column 99 to bowl 97. Bowl 97 is also provided with a plurality of legs 123, such legs 123 being of sufficient size and shape to provide stability to apparatus 95. That is, with the size of holder 96, color pallets 98 and a plurality of brushes being held thereby, legs 123 may be designed to extend outwardly more than is shown in FIGS. 8 and 9 to make apparatus 95 sufficiently stable during normal use. In addition, during use when bowl 97 contains water for cleaning artists' brushes, the center of gravity of apparatus 95 will be lowered, and apparatus 95 will be even more stable.

In other embodiments, holder 96 can be connected to central column 99 by other means as disclosed and suggested herein and as would generally occur to one skilled in the art. For example, and without limitation, central column 99 can extend up through holder 96 and connect directly with handle 100. Alternatively, holder 96 can have a plurality of legs (not shown), extending inwardly for connection to central column 99 by any appropriate means such as screws or pin assemblies. Such legs can be at the top or bottom of holder 96 or anywhere in between. The components of apparatus 95 are contemplated to be made of plastic, but any appropriate material capable of supporting the attendant weights and forces may be used. Handle 100 is connected to holder 96 by any appropriate means.

In embodiments, holder 96 can be designed to rotate similar to a "lazy Susan"-type assembly, providing for easy access to all sides of holder 96 and color pallets 98 by multiple users. Such readability can be provided with the use of one or more ball-bearing assemblies (not shown) as would occur to those skilled in the art. For example, and without limitation, holder 96 can be rotatably connected to central column 99 by inserting a ball-bearing assembly between the top of column 99 and base 104. Alternatively, central column 99 could be made in two pieces—an upper column and a lower column—with a ball bearing assembly connected therebetween to permit such upper column and holder 96 to rotate as a unit relative to such lower column and bowl. In another embodiment, holder 96 has a frusto-conical configuration like holder 11 of apparatus 10 of FIG. 1.

Figure 10:
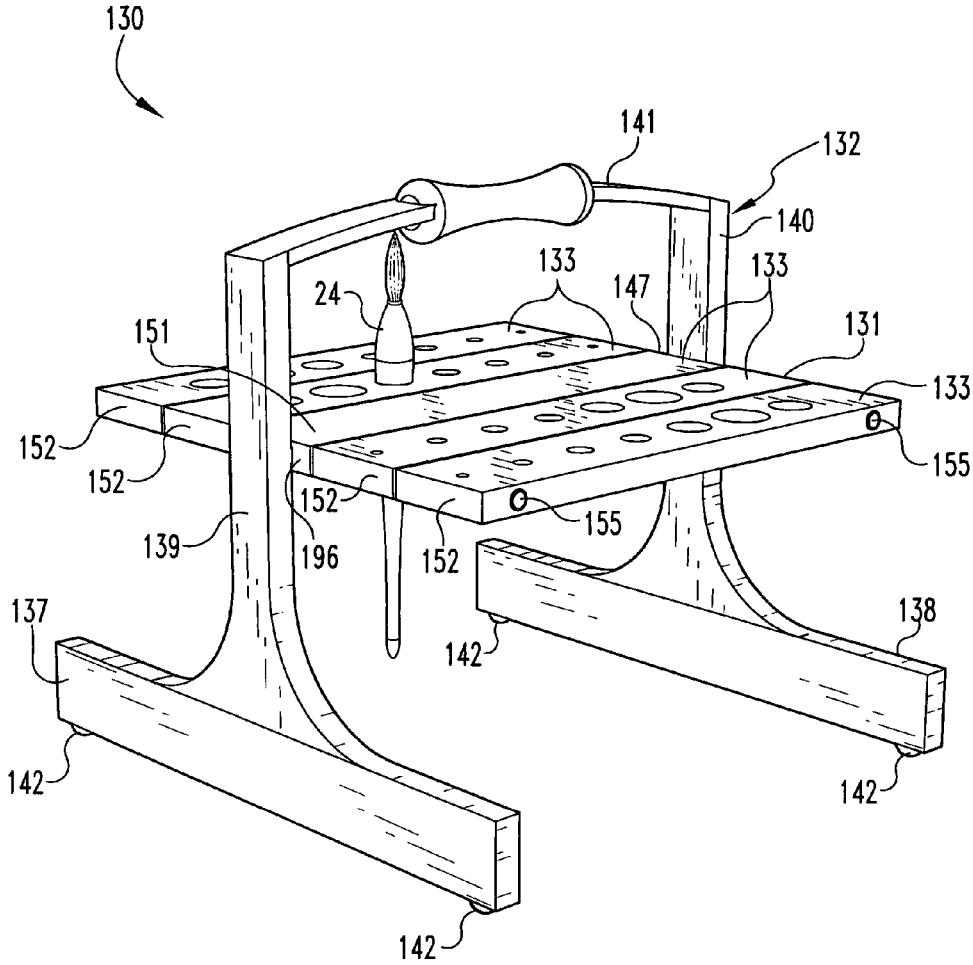
FIG. 10 is a perspective view of an apparatus 130 for holding and organizing artist supplies in accordance with another embodiment of the present invention.
Figure 11:
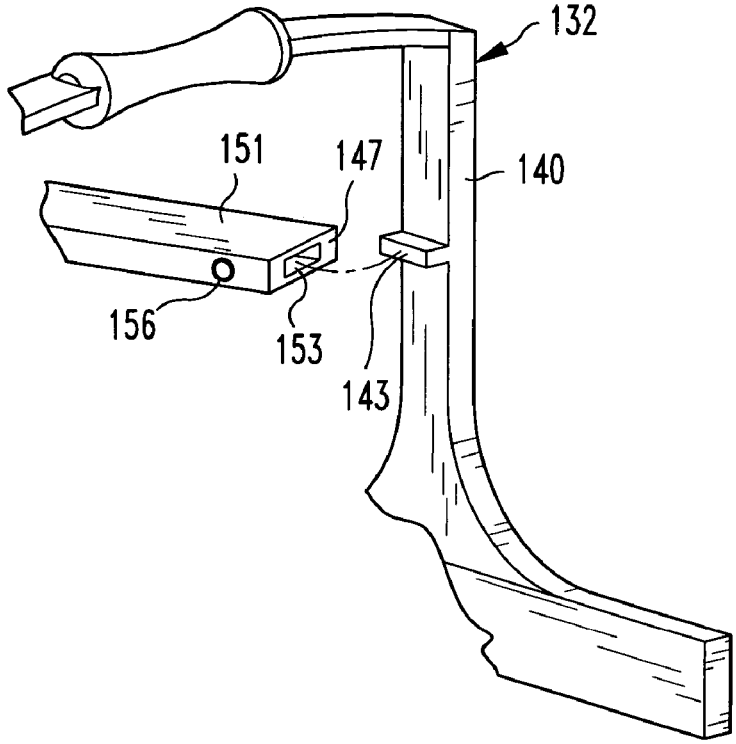
FIG. 11 is a perspective, fragmented view of a portion of apparatus 130 of FIG. 10 and showing the interconnection between anchor plate 151 and leg 140.
Figure 12:
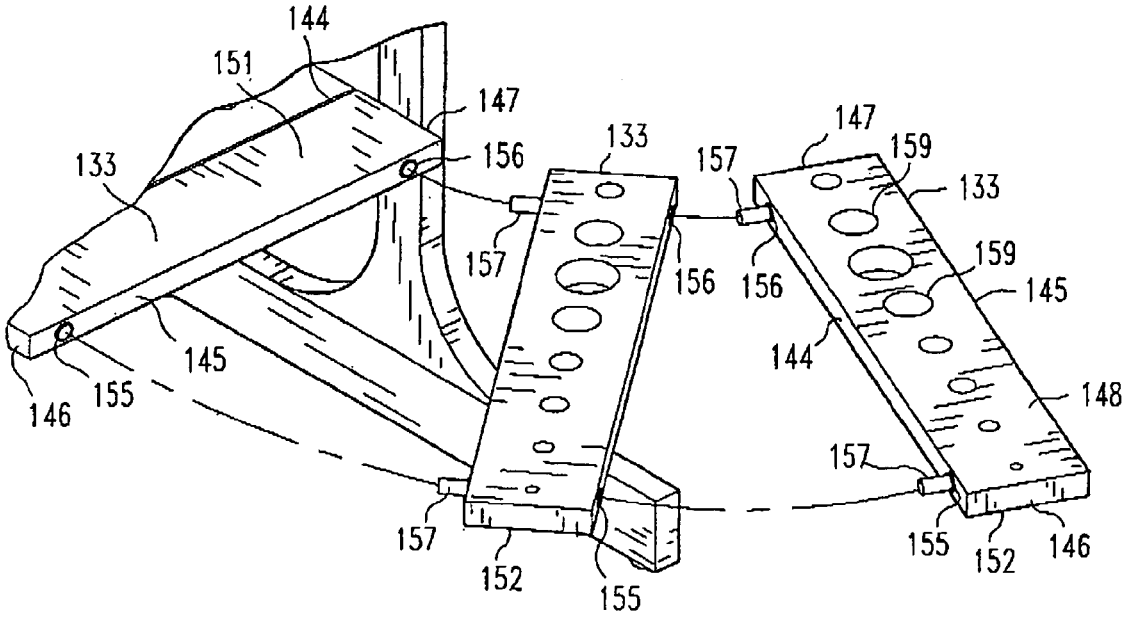
FIG. 12 is a perspective, fragmented and exploded view of a portion of apparatus 130 showing the relationship among holder plates 133.

Referring to FIGS.10–12, there is shown an apparatus 130 for holding and organizing artist supplies in accordance with another embodiment of the present invention. Apparatus 130 generally includes a holder 131 and a base 132. Holder 131 comprises a plurality of substantially identical brush bolder plates 133. Base 132 comprises feet 137 and 138, support legs 139 and 140 each extending upwardly from one of feet 137 and 138, as shown, and a handle 141 extending between and connected to legs 139 and 140 at the tops thereof, as shown. Feet 137 and 138 legs 139 and 140 and handle 141 are formed as a substantially rigid unit with sufficient flexibility to permit legs 139 and 140 to be bent slightly away from each other at handle 141 to permit connection thereto of holder 131, as described herein. Feet 136 and 137 extend in opposite directions from the intersections with their legs 139 and 140 an amount to provide sufficient stability in view of the number of holder plates 133 connected with holder 131. Feet 136 and 137 include support pads 142 on their underside to stabilize apparatus 130 on a table or other such surface. Approximately 10 inches above the lowest, ground-engaging surface of feet 136 and 137, a shaped stub mount 143 extends inwardly from each leg 139 and 140 (one mount 143 shown in FIG. 11). Stub mounts 143 are preferably rectangular and may be more or less than 10 inches up from "ground", but 10 inches is believed optimum to permit adequate clearance for most brushes 24 being held by holder 131, with alternative embodiments including such distance being between about 5 and 15 inches, and between about 9 and 11 inches.

Each plate 133 is generally rectangular with opposing long edges 144 and 145, opposing short edges 146 and 147 and a top face 148. Holder plates 133 include an anchor plate 151 and at least one wing plate 152. In the embodiment of FIG. 10 there are four wing plates 152. Defined in each of the opposing short edges 146 and 147 of anchor plate 151 is a hole 153 sized and shaped to snugly receive a stub mount 143 therein. In assembly, anchor plate is positioned between opposing legs 139 and 140 with stub mounts 143 (one shown) received within the rectangular holes 153 at opposing ends (edges) 146 and 147. This assembly is accomplished by slightly bending legs 139 and 140 outwardly at handle 141. Due to the registration of rectangular holes 153 and stub mounts 143, anchor plate 151 is held securely and immovably relative to base 132.

Defined in each of the opposing long edges 144 and 145 of holder plate 133 are two holes 155 and 156, each of which being sized to receive by pressure fit a connection pin 157. Thus, with anchor plate 151 secured to legs 139 and 140, wing plates 152 are connected long end-to-long end with pins 157 extending through aligned holes 155 and 156 of abutting plates, as shown. Alternative embodiments are contemplate wherein the hole (155 and 156) and pin (157) combinations may be replaced with a T-flange and T-slot combination, as used for apparatus 95 for FIG. 8, or any other structure that would securely, but removably connected the holder plates 133 together.

Each wing plate 152 defines a plurality of holes 159, which are of varying sizes to receive and hold a variety of different sized paint brushes 24. In one embodiment, the hole sizes include 3/16", 5/16", 7/16", 1/2", 3/4", and 1.0". Such holes 159 may be distributed with all the 1.0" holes on one wing plate 152, all the 3/4" holes on another wing plate 152, and so on. Alternatively, each wing plate 152 may have one at least one hole 159 of each size. Other combinations of hole sizes and layouts are contemplated as would be considered by a person of ordinary skill in the art.

Other embodiments are contemplated wherein, instead of holder 131 being rigidly connected to base 132 by rectangular-shaped stub mounts 143 and holes 153, there is provided apparatus for permitting brush holder 131 to be rotated relative to base 132. For example, and without limitation, hole 153 could be a round, threaded hole and, instead of stub mounts 143, a thumbscrew (not shown) extends through each leg 139 and 140 (at the position of the replaced stub mount 143) and into the threaded holes in the ends of anchor plate 151. When brush holder 131 is rotated to its desired position, such thumb screws are tightened to secure the holder 131 at that angular position. Similar to the other embodiments described herein, the components of apparatus 130 are made of plastic to facilitate cleaning to provide a lightweight apparatus. However, other materials may be used as would generally occur to those skilled in the art. As described herein, the long edges 144 and 145 of anchor plate 151 and/or one or more wing plates 152 are substantially straight. Other embodiments are contemplated wherein such long edges may be non-straight. For example, and without limitation, such long edges may be arcuate, jagged or notched to provide additional strength, to facilitate an alternate connection method and/or to vary the aesthetic appearance.

Figure 13:
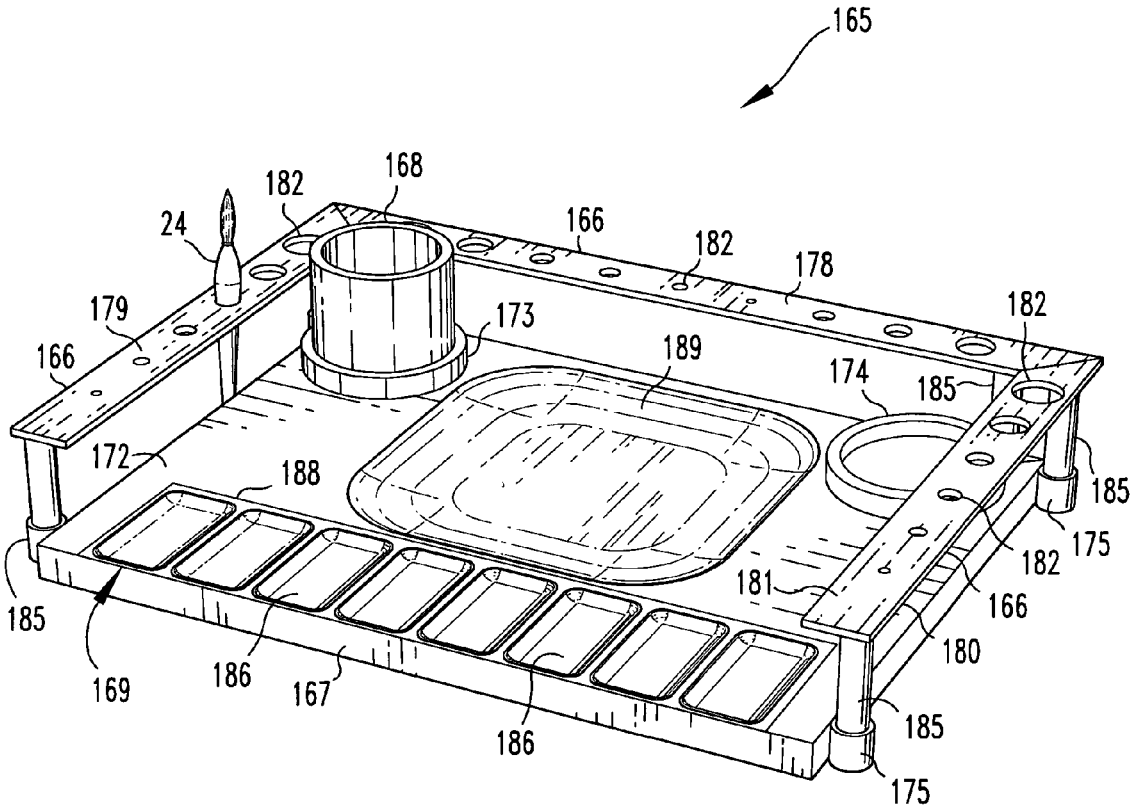
FIG. 13 is a perspective view of an apparatus 165 for holding and organizing artist supplies in accordance with another embodiment of the present invention.

Referring to FIG. 13, there is shown an apparatus 165 for holding and organizing artist supplies in accordance with another embodiment of the present invention. Apparatus 165 generally includes brush holders 166, a base 167, at least one bowl 168, and a color pallet 169. Base 167 has an upper surface 172 to which are connected mounting rings 173 and 174 for holding bowl 168 and a second bowl (not shown). Base 167 further includes three pairs of mounting brackets 175 for holding brush holders 166. Mounting rings 173 and 174 are each sized and shaped to snugly receive and hold one of the bowls 168. Bowls 168 and mounting rings 173 and 174 are round in the present embodiment, but other embodiments contemplate bowls 168 and mounting rings 173 and 174 to be shaped otherwise, such as rectangular or triangular. In one embodiment, bowls 168 are configured to hold water for cleaning paint brushes or other instruments; however, bowls 168 can be used to hold other artist supplies such as, and without limitation, chalk, pencils and erasers.

There are three holders 166 comprising a rear holder 178, and opposing side holders 179 and 180. Each holder 166 comprises a plate 181, which defines a plurality of holes 182, the number and sizes of such holes 182 varying as desired to accommodate the variety of brushes contemplated for use with apparatus 165 of various sizes for receiving brushes 24 of various sizes. Each holder 166 is connected with base 167 by posts 185 that are rigidly connected to the underside of plate 181. Mounting brackets 175 are cup-shaped and are sized and shaped to receive the bottom ends of posts 185, as shown. Each holder 166 can thus be connected with base 167 by inserting the bottom ends of posts 185 in their respective mounting brackets 175, as shown. The three brush holders 178-180 may be formed as three holders, as shown, or may be rigidly connected together as a single holder. Means may also be provided for securing holders 166 to base 167 by using any appropriate fasteners, such as screws (not shown) holding posts 185 to mounting brackets 175.

As shown, color pallet 169 is divided into numerous sections 186 (eight are shown, but the number may be more or less, as desired) to hold and separate various paint colors. In one embodiment, base 167 defines the various sections 186 as recesses defined directly in the upper surface 172 of base 167. Alternatively, pallet 169 may be formed as a separate unit, having numerous sections 186, and the separate pallet unit 169 is received and held in a recess 188 that is defined in upper surface 172. Other configurations are also contemplated as would occur to a person of ordinary skill, such as the separate pallet unit 169 sitting atop upper surface 172 and held thereat by any appropriate fastener, such as screws or Velcro®. Also provided is a paint mixing area 189 centrally located on base 167 for mixing various paint colors as desired by the user of apparatus 165. Like color pallet 169, mixing area 189 may be formed directly in the upper surface 172 of base 167, or it may be formed as separate unit that sits within a recess or is mounted atop base 167.

Alternative embodiments are contemplated wherein apparatus 165 is configured differently than what has been described herein. For example, and without limitation, there may be more or fewer bowls 168, or the sizes and shapes of bowls 168, pallet 169 and/or mixing area 189 may be varied from what is shown. In one embodiment, the components of apparatus 165 are made of plastic; however, any other appropriate material may be used as would generally occur to those skilled in the art.

Figure 14:
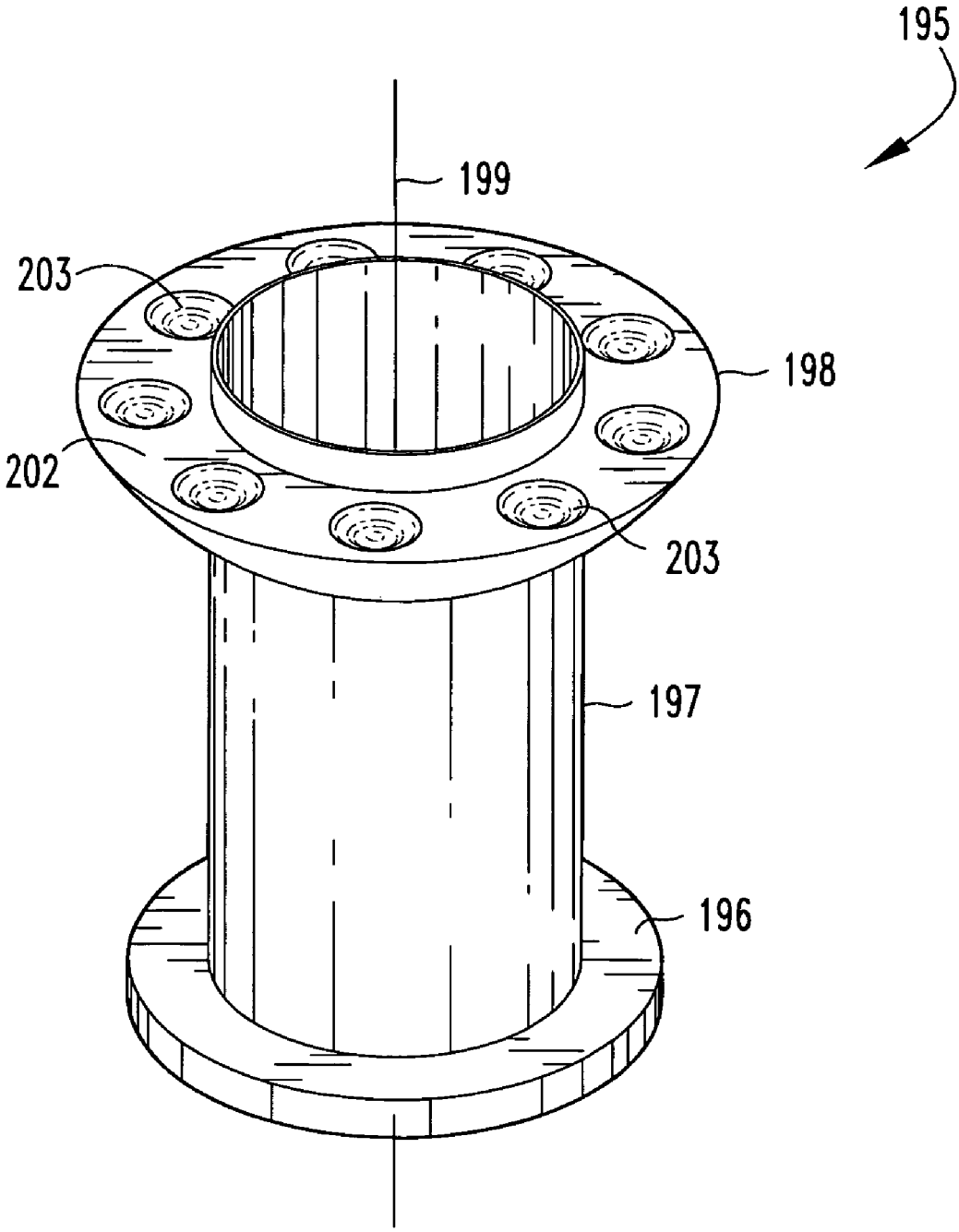
FIG. 14 is a perspective view of an apparatus 195 for holding and organizing artist supplies in accordance with another embodiment of the present invention.

Referring to FIG. 14, there is shown an apparatus 195 for holding and organizing artist supplies in accordance with another embodiment of the present invention. Apparatus 195 generally includes a base 196, a bowl 197, and a color pallet 198, all of which are generally circular-shaped and have a common axis 199. Bowl 197 is a cylindrically-shaped cup and is rigidly mounted to base 196 by any appropriate means, such as screws. Alternatively, bowl 197 and base 196 may be a single, homogeneously formed unit. In one embodiment, bowl 197 is configured to hold water for cleaning artists' implements, but can be used to contain various other artist supplies. Color pallet 198 is configured to form an annular ring about bowl 197 at the top thereof. Color pallet 198 is includes an upper, annular surface 202 that defines a plurality of recesses 203 for receiving a variety of different paint colors. Color pallet 198 is connected to bowl 108 by any appropriate means including, for example, screws, pins, or adhesive. Alternatively, pallet 198 may include a locking ridge (not shown) that engages and registers with a complementary-shaped locking ridge defined on the outer surface of bowl 197, and pallet 198 is connected to bowl 197 by sliding and rotating pallet 198 relative to bowl 197. Color pallet 198 is generally connected near the top of bowl 197, but may be located farther down, as desired.

Additionally, color pallet 198 can be designed to rotate similar to a "lazy Susan"-type assembly, providing for easy access to all paint colors contained within color pallet 198. This can be accomplished with the use of a ball-bearing assembly or other type of assembly to rotate or spin an object as would occur to those skilled in the art. Apparatus 195 is made of plastic, but other appropriate materials may be used as would generally occur to those skilled in the art.

Figure 15:
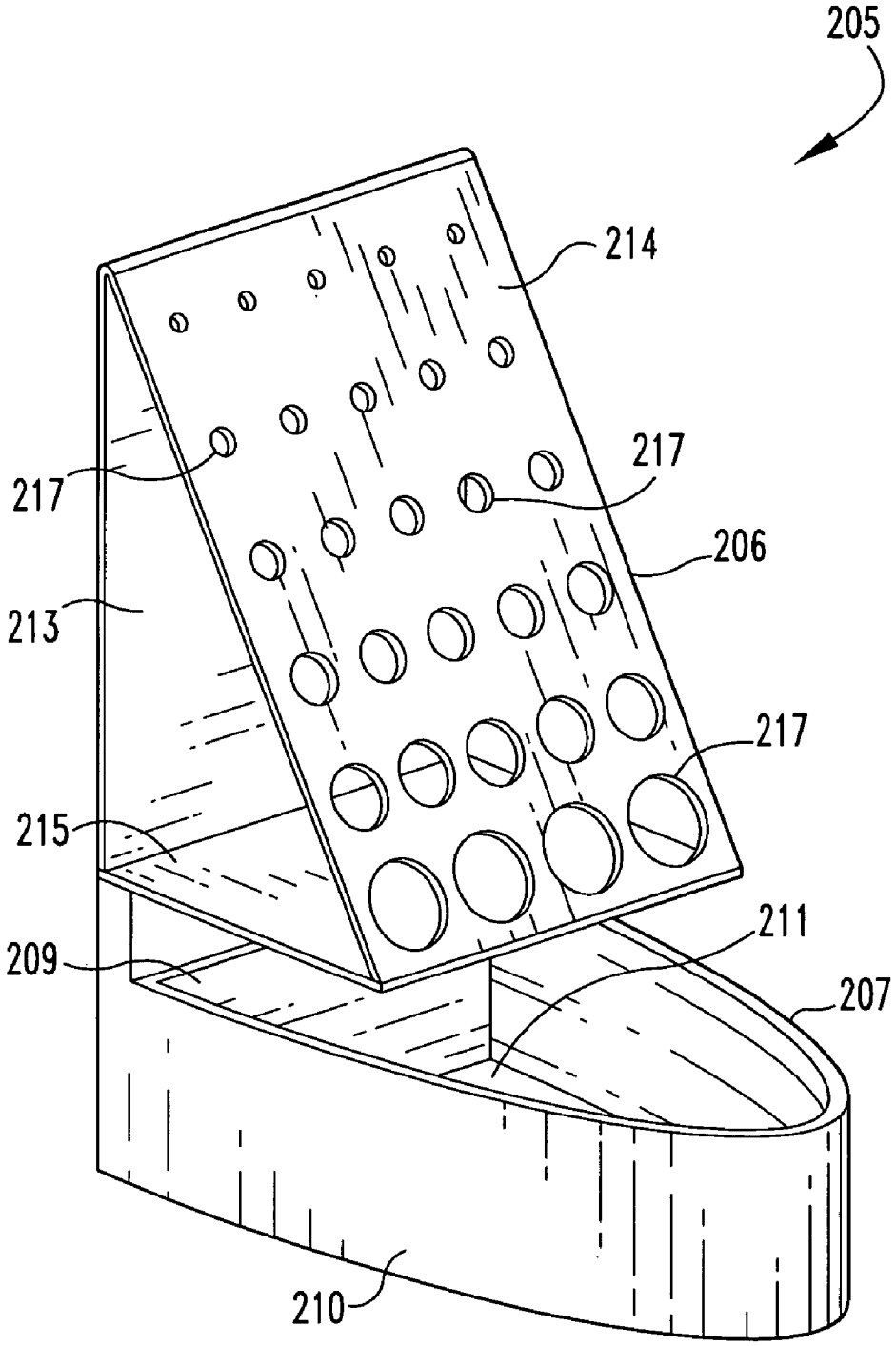
FIG. 15 is a perspective view of an apparatus 205 for holding and organizing artist supplies in accordance with another embodiment of the present invention.

Referring to FIG. 15, there is shown an apparatus 205 for holding and organizing artist supplies in accordance with another embodiment of the present invention. Apparatus 205 generally includes a holder 206 and a bowl 207. Bowl 194 is generally arc-shaped with a generally straight rear wall 209, an arc or parabolic-shaped front wall 210 and a generally flat bottom 211, all of which together form a bowl for holding water. Alternatively, bowl 194 may be used to hold various other artists' supplies. The generally flat bottom 211 also provides a stable base for apparatus 205 to sit on a table or other such area. Holder 206 is triangular-shaped, having a flat back wall 213, a front wall 214 and a connecting bottom wall 215. Front wall 214 forms an angle with back wall 213 of between about 20 and 40 degrees, and about 30 is preferred. Front wall 214 defines a number of variously sized and spaced holes 217 for receiving and holding paint brushes (not shown) of various types, shapes and sizes. The number and sizes of holes 217 may vary as desired to accommodate the variety of brushes contemplated for use with apparatus 205.

Figure 16:
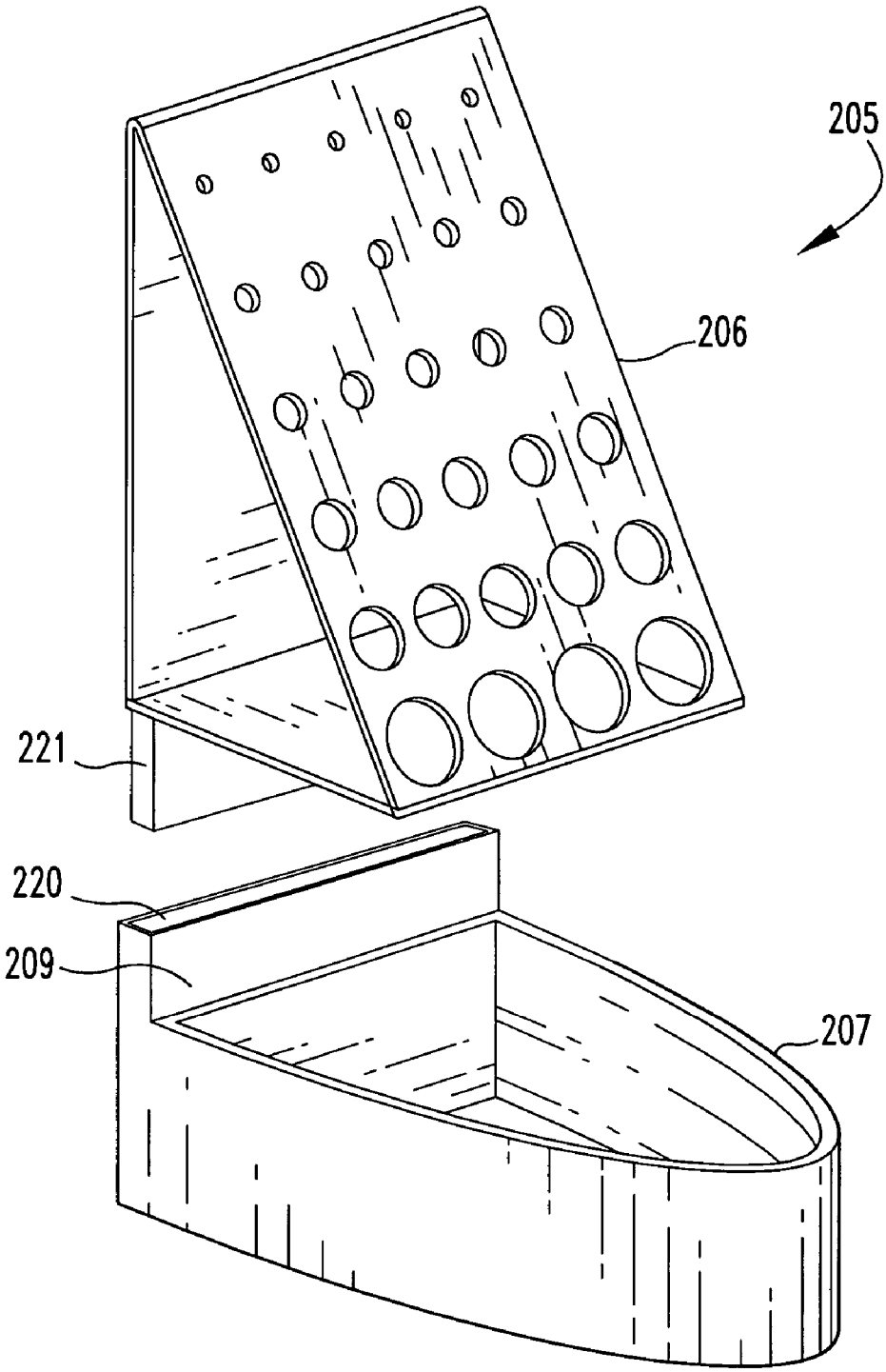
FIG. 16 is an exploded view of the apparatus 205 of FIG. 15.
Figure 17:
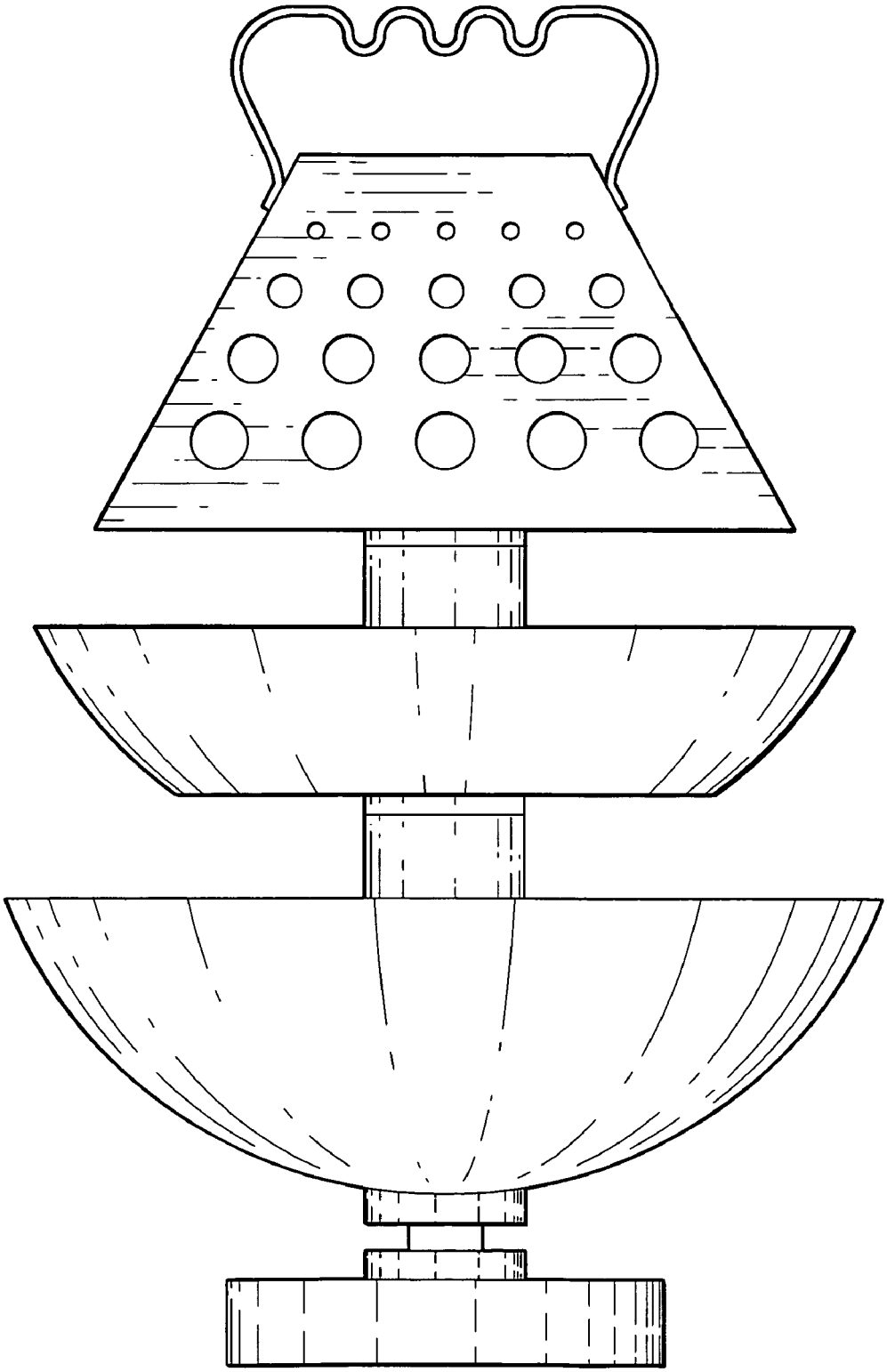
FIG. 17 is an elevational view of the apparatus 70 of FIG. 7.
Figure 18:
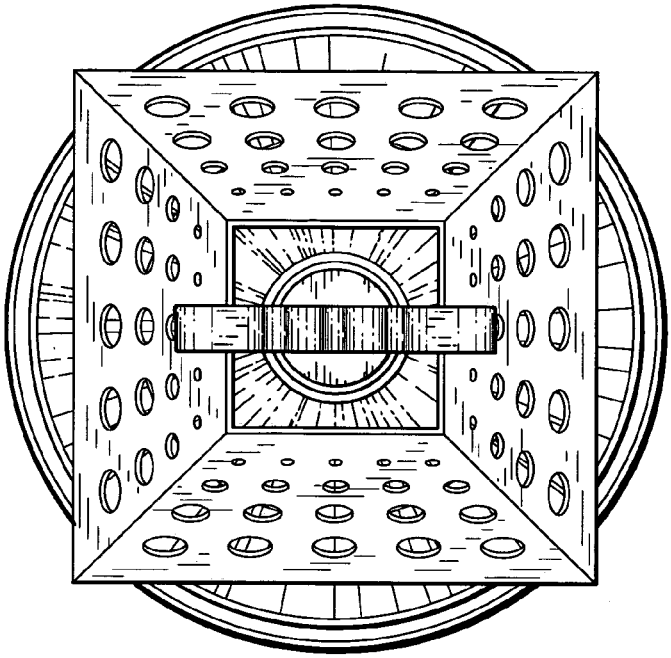
FIG. 18 is a top view of the apparatus 70 of FIG. 7.
Figure 19:
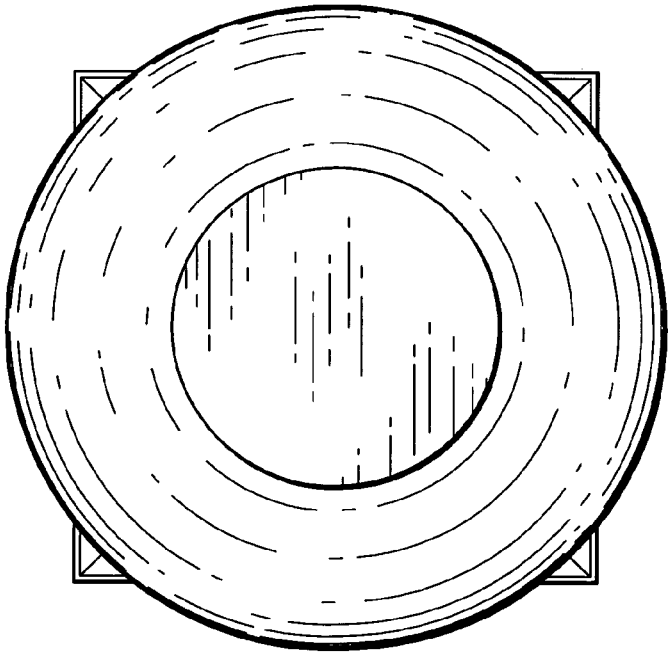
FIG. 19 is a bottom view of the apparatus 70 of FIG. 7.
Figure 20:
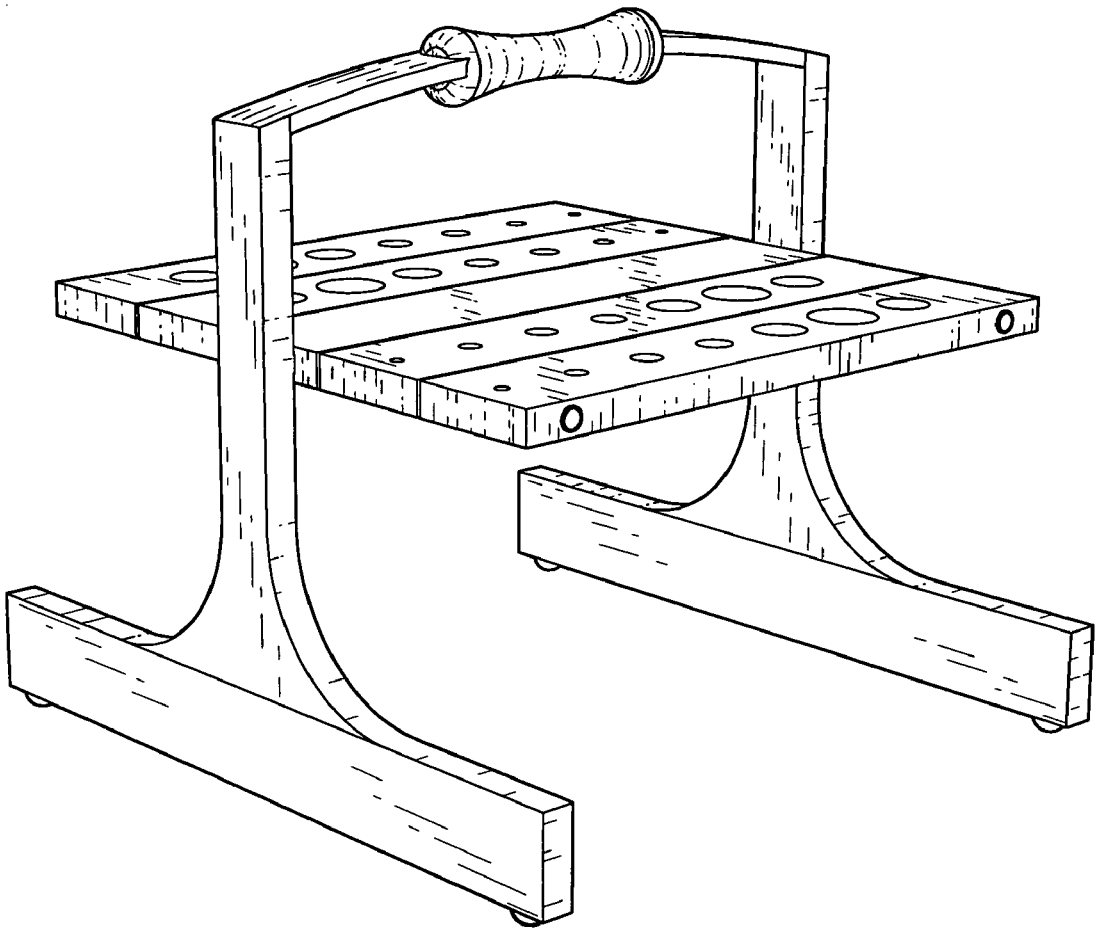
FIG. 20 is a perspective view of the apparatus 130 of FIG. 10
Figure 21:
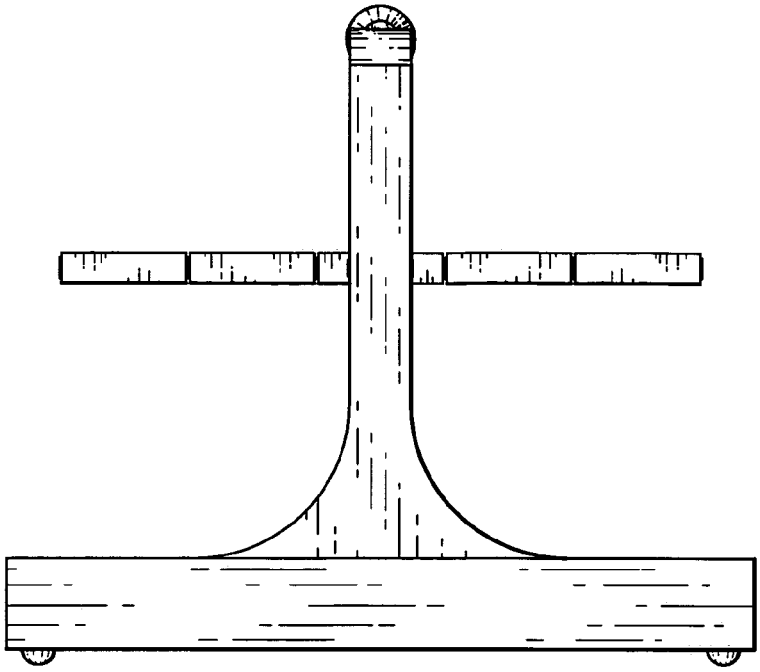
FIG. 21 is a side view of the apparatus 130 of FIG. 10.
Figure 22:
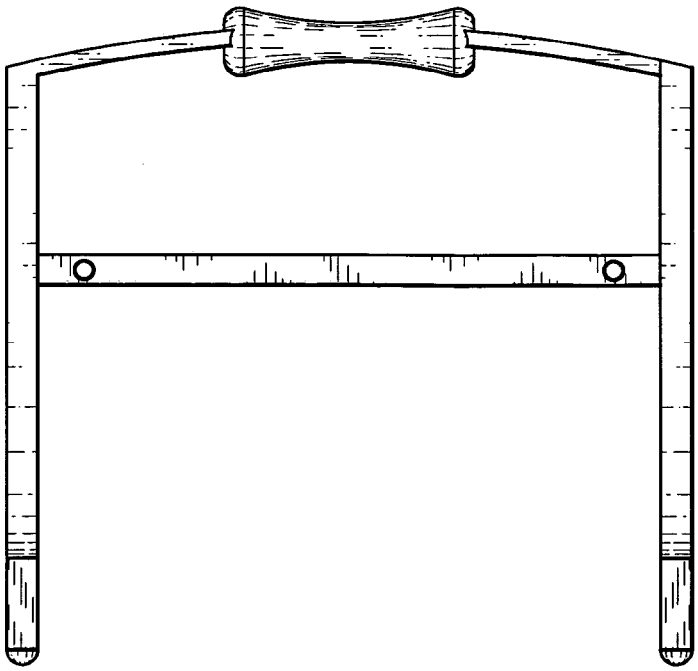
FIG. 22 is a front view of the apparatus 130 of FIG. 10.
Figure 23:
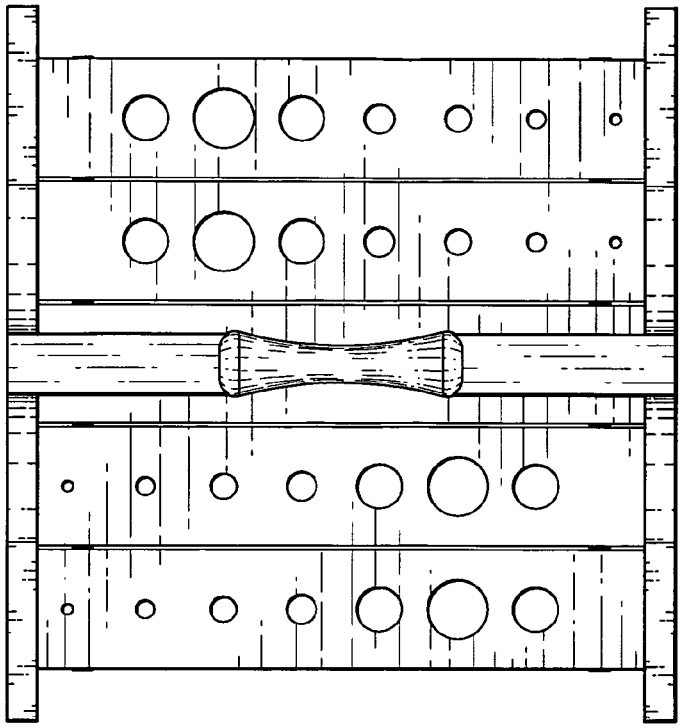
FIG. 23 is a top view of the apparatus 130 of FIG. 10.
Figure 24:
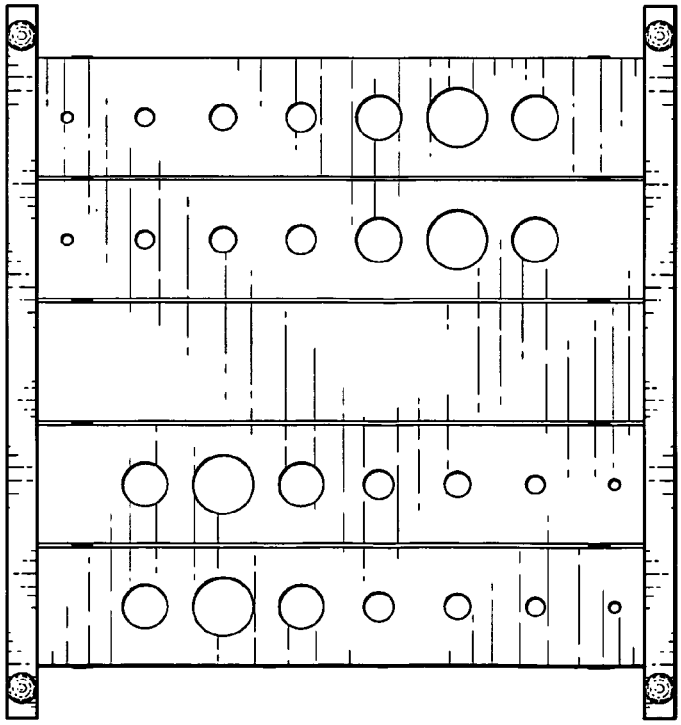
FIG. 24 is bottom view of the apparatus 130 of FIG. 10.
Figure 25:
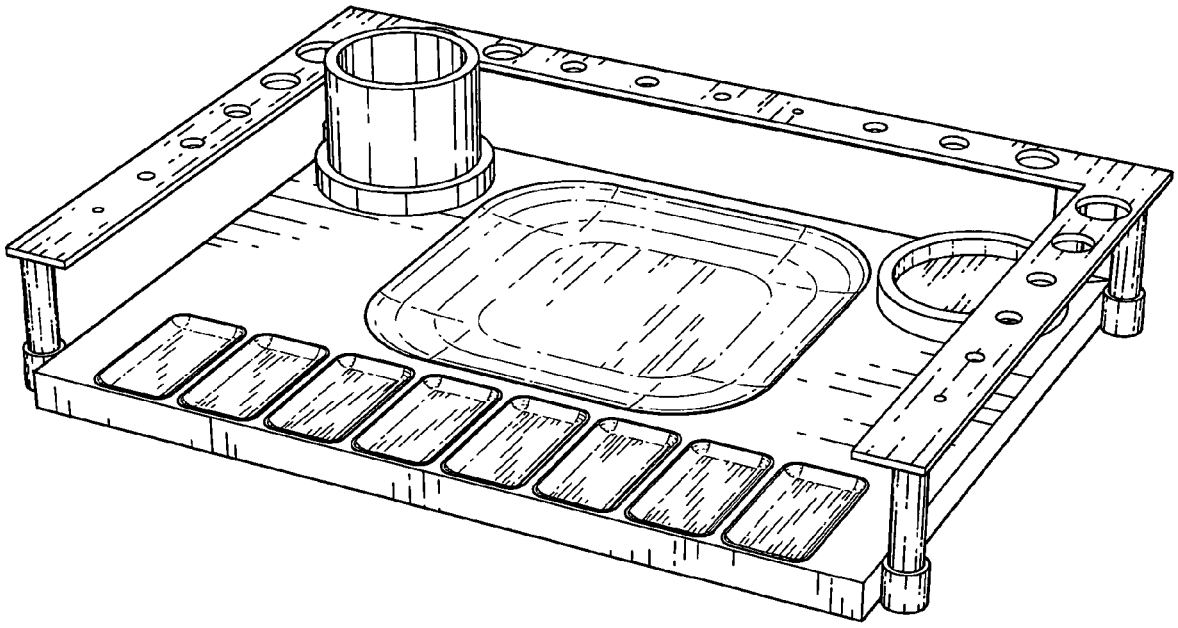
FIG. 25 is an perspective view of the apparatus 165 of FIG. 13
Figure 26:
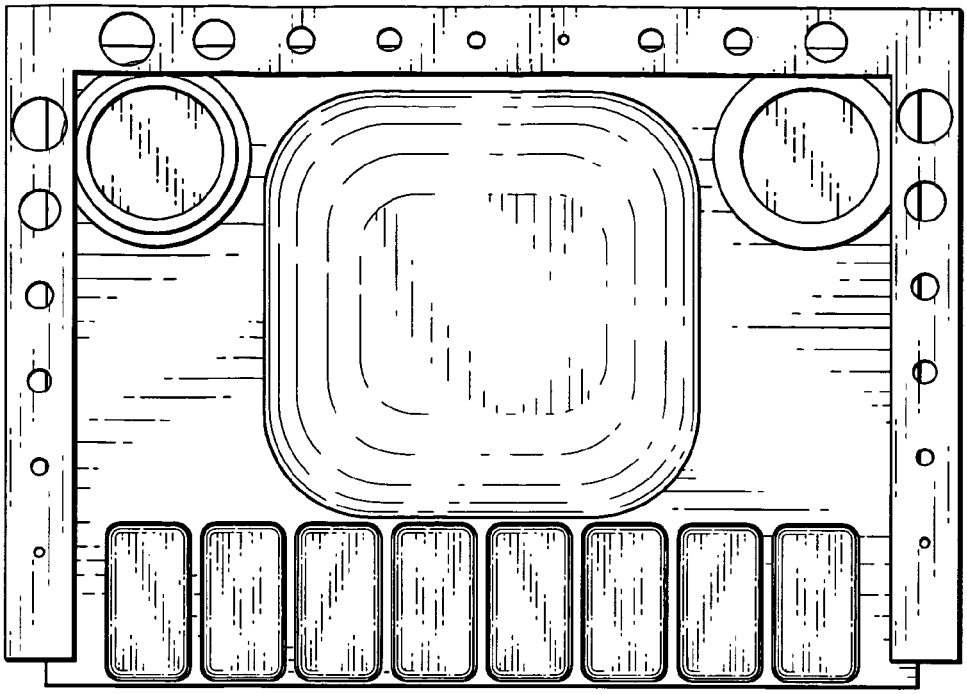
FIG. 26 is a top view of the apparatus 165 of FIG. 13.
Figure 27:
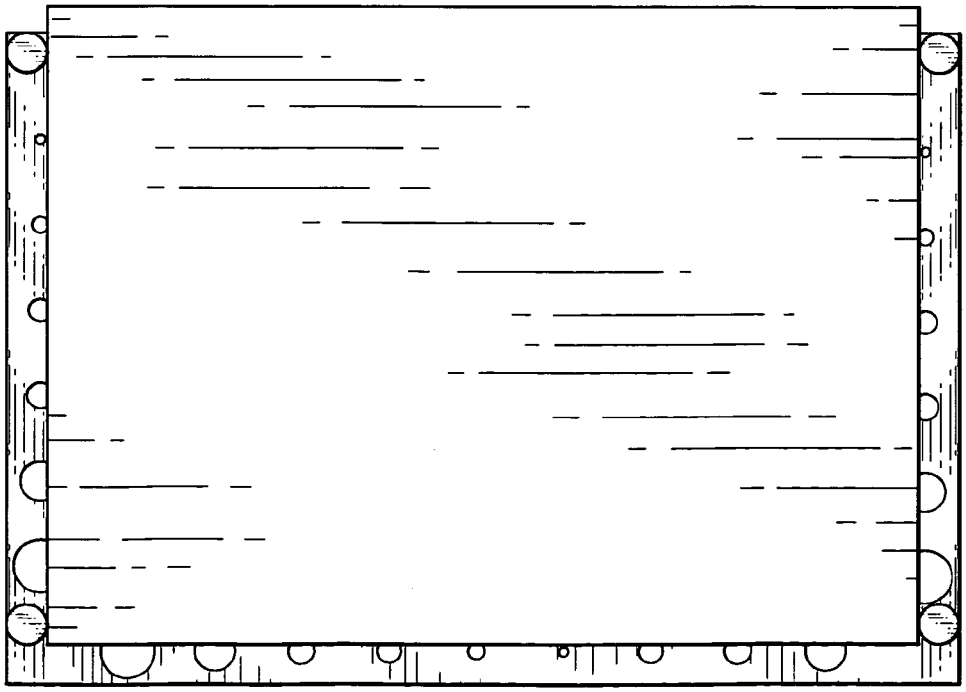
FIG. 27 is a bottom view of the apparatus 165 of FIG. 13.
Figure 28:
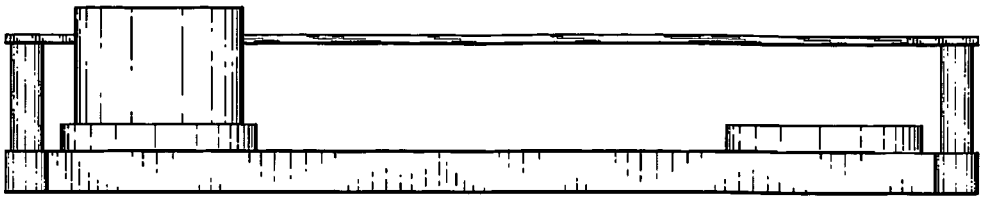
FIG. 28 is a front view of the apparatus 165 of FIG. 13.
Figure 29:
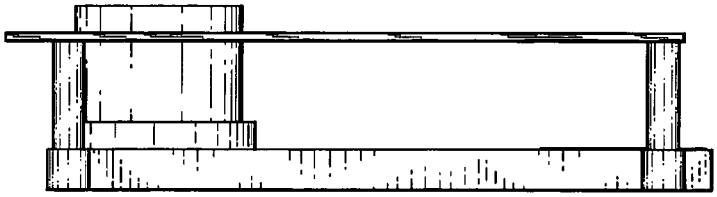
FIG. 29 is a side view of the apparatus 165 of FIG. 13.
Figure 30:
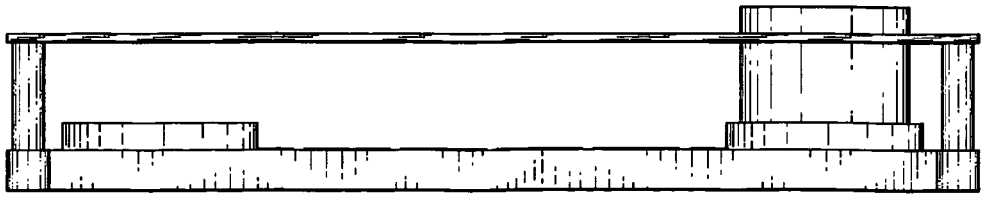
FIG. 30 is a rear view of the apparatus 165 of FIG. 13.

Referring to FIG. 16, the rear wall 209 of bowl 207 extends upwardly from arcuate front wall and defines a rectangular-shaped slot 220. From bottom wall 215 at back wall 213 a post 221 extends downwardly that is sized and shaped complementary to slot 220. In assembly, holder, 206 is lowered to bowl 207 whereby post 221 extends snugly into slot 220 until bottomed wall 215 engages the top edge 222 of wall 209. Holder 206 is thus support in the position shown in FIG. 15 upon bowl 207. Holder 206 may be releasably secured to bowl 207 by any appropriate means such as screws, bolts, pins and the like. Alternatively, holder 206 may be permanently bonded to bowl 207 in any known manner or created as a single, homogeneous unit. In one embodiment, apparatus 205 is made of plastic, but other appropriate materials may be used as would generally occur to those skilled in the art.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. An apparatus for holding and organizing artist supplies including paint brushes, comprising:

a base having at least two legs and a ground-engaging surface;

a handle connected with said base; and, a holder including an anchor plate with a long edge and at least one wing plate with a long edge, the anchor plate being supported by and between the at least two legs a distance above the ground-engaging surface, and wherein the at least one wing plate is connected at its long edge to the anchor plate at its long edge and is substantially coplanar with the anchor plate, and wherein the at least one wing plate defines a plurality of variously sized holes sized to receive and hold a plurality of variously sized paint brushes.

2. The apparatus for holding and organizing artist supplies including paint brushes of claim 1 wherein the distance is between about 5 and 15 inches.

3. The apparatus for holding and organizing artist supplies including paint brushes of claim 1 wherein the distance is between about 9 and 11 inches.

4. The apparatus for holding and organizing artist supplies including paint brushes of claim 1 wherein the distance is about 10 inches.

5. The apparatus for holding and organizing artist supplies including paint brushes of claim 1 wherein the long edge of the anchor plate includes opposing first and second long edges and wherein there are at least two wing plates, one connected to the first long edge and one connected to the second long edge.

6. The apparatus for holding and organizing artist supplies including paint brushes of claim 1 wherein the long edge of the anchor plate includes opposing long edges and wherein there are at least four wing plates each having opposing long edges, the wing plates being serially connected, long edge to long edge, to each other and to the anchor plate, all such plates being substantially coplanar.

7. The apparatus for holding and organizing artist supplies including paint brushes of claim 1 wherein the long edge of anchor plate includes opposing long edges, and wherein one of the at least one wing plates is a first wing plate and is connected at its long edge to the anchor plate at one of its long edges, and wherein another of the at least one wing plates is a second wing plate and is connected at its long edge to one of the anchor plate and the first wing plate.

8. The apparatus for holding and organizing artist supplies including paint brushes of claim 1 wherein the anchor plate includes opposing short edges, and the anchor plate is supported by and between the at least two legs at the short edges.

9. The apparatus for holding and organizing artist supplies including paint brushes claim 8 wherein one of the short edges defines a hole and one of the legs includes a stub mount complementarily sized and shaped for receipt in the hole.

10. The apparatus for holding wad organizing artist supplies including paint brushes of claim 9 wherein the hole has a non-round shape.

11. The apparatus for holding and organizing artist supplies including paint brushes of claim 9 wherein the hole has a rectangular shape.

12. The apparatus for holding and organizing artist supplies including paint brushes of claim 8 wherein one of the legs defines a hole and one of the short edges includes a stub mount complementarily sized and shaped for receipt in the hole.

13. The apparatus for holding and organizing artist supplies including paint brushes of claim 12 wherein the hole has a non-round shape.

14. The apparatus for holding and organizing artist supplies including paint brushes of claim 12 wherein the hole has a rectangular shape.

15. The apparatus for holding and organizing artist supplies including paint brushes claim 1 wherein at least one plate is connected to another plate by a hole and pin combination.

16. The apparatus for holding and organizing artist supplies including paint brushes of claim 15 wherein the hole and pin combination includes one long edge of a plate defining at least one pin hole and the long edge of an adjacent plate having a pin extending outwardly therefrom and tightly into the pinhole of the adjacent plate.

17. An apparatus for holding and organizing artist supplies including paint brushes, comprising:

a base having two legs and a ground-engaging surface;

a handle extending between the legs of said base; and, a holder including a plurality of plates with long edges and being connected to each other at such long edges, at least one of the plates being immovably connected to and between the two legs a distance above the ground-engaging surface, and wherein at least one of the plates defines a plurality of variously sized holes sized to receive and hold a plurality of variously sized paint brushes.

* * * * *